US008285183B2

(12) United States Patent
Nishida et al.

(10) Patent No.: US 8,285,183 B2
(45) Date of Patent: Oct. 9, 2012

(54) IMAGE FORMING APPARATUS

(75) Inventors: Satoshi Nishida, Numazu (JP); Kohei Okayasu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 12/759,973

(22) Filed: Apr. 14, 2010

(65) Prior Publication Data

US 2010/0260523 A1 Oct. 14, 2010

(30) Foreign Application Priority Data

Apr. 14, 2009 (JP) ..... 2009-097636

(51) Int. Cl.
*G03G 15/20* (2006.01)

(52) U.S. Cl. ..... 399/327; 399/33; 399/67; 219/216

(58) Field of Classification Search ..... 399/33, 399/67, 327
See application file for complete search history.

(56) References Cited

U.S. PATENT DOCUMENTS

| | | | | |
|---|---|---|---|---|
| 5,865,121 | A * | 2/1999 | Testardi et al. | 101/483 |
| 7,203,438 | B2 | 4/2007 | Omata et al. | |
| 7,519,320 | B2 | 4/2009 | Aoki et al. | |
| 7,650,105 | B2 | 1/2010 | Ogawa et al. | |
| 7,702,249 | B2 | 4/2010 | Nishida | |
| 7,734,241 | B2 | 6/2010 | Nishida et al. | |
| 2004/0114975 | A1 * | 6/2004 | Sano et al. | 399/328 |
| 2008/0107437 | A1 | 5/2008 | Nishida | |

FOREIGN PATENT DOCUMENTS

| | | |
|---|---|---|
| JP | 5-158375 | 6/1993 |
| JP | 2003-270985 | 9/2003 |
| JP | 2004-157524 | 6/2004 |
| JP | 2008-90172 | 4/2008 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

An image forming apparatus forms an unfixed toner image on a sheet and includes a fixing unit including a fixing roller, a back-up member forming a nip with the fixing roller, and a rotatable heater contactable to and heating the fixing roller. The sheet is output from the apparatus after the unfixed toner image is fixed on the sheet. In a cleaning mode for cleaning the fixing unit, a predetermined unfixed toner image is formed on the sheet, the sheet is fed to the fixing unit, the toner is transferred from the sheet onto the fixing roller in the fixing nip, the toner transferred onto the fixing roller is brought into contact to the heating member, and thereafter, the toner on the fixing roller is transferred onto the sheet in the fixing nip.

15 Claims, 25 Drawing Sheets

IMAGE FORMING APPARATUS

FIELD OF THE INVENTION AND RELATED ART

The present invention relates to an image forming apparatus such as an electrophotographic copying machine, a laser beam printer, etc., which has a fixation unit for thermally fixing a toner image (image formed of toner) to a sheet of recording medium.

A fixation unit having its heat source outside its fixation roller has been proposed as a thermal fixation unit for a copying machine, a printer, and the like.

This type of fixation unit has: a fixation roller; a pressure roller which is pressed against the fixation roller to form a nip through which a sheet of a recording medium is conveyed; and a heating member for heating the peripheral surface of the fixation roller. There are various types of heating members, for example, a heating roller having an internal halogen heater, an endless belt placed in contact with a ceramic heater in such a manner that its inward surface is in contact with the heater, etc. The fixation roller of this type of fixation unit is provided with an elastic layer, which is for ensuring that the fixation unit is provided with a nip (fixation nip) that is wide enough to ensure that the fixation unit is satisfactory in performance in terms of fixation. Further, in order to quickly increase the surface temperature of the fixation roller to a level high enough for satisfactory fixation, the fixation roller is heated from the outward side of its peripheral surface.

However, a fixation unit, such as the above-described one, the fixation roller of which is heated from the outward side of its peripheral surface, has been problematic in that its heating member (external heating member) is contaminated.

More specifically, in the case of a fixation unit which employs an external heating member, the offset toner resulting from jamming of a recording medium or the like sometimes transfers onto the external heating member. Once the offset toner transfers onto the external heating member, the offset toner on the external heating member is not going to be completely removed by the first sheet of recording media conveyed after the removal of the jammed sheet, because it is on the external heating member, that is, a member which does not directly come into contact with a sheet of the recording media. Therefore, the transferred toner on the external heating roller irregularly transfers back onto the fixation roller, thereby soiling the image on a sheet of recording medium.

As one of the means for preventing the occurrence of the above-described problem, it has been proposed to make the external heater slipperier than the fixation roller (Japanese Laid-open Patent Application 2004-15752).

Making the external heating member slipperier than the fixation roller makes the adhesion between the fixation roller and toner greater than the adhesion between the external heating member and toner. Therefore, even if toner adheres to the fixation roller in the fixation nip, and then, is made to reach the external heating member by the rotation of the fixation roller, it does not adhere to the external heating member, remaining therefore on the fixation roller. Then, the toner remaining of the fixation roller is returned by further rotation of the fixation roller, to the fixation nip, in which it is fixed to a sheet of the recording media. Then, it is discharged with the sheet P.

However, if the external heating member is made slipperier than the fixation roller as it was according to the prior arts, it is possible that toner and the like will collect on the external heating member.

When a sheet of the recording media is heated for the fixation by the fixation roller, contaminants such as paper dust and/or the filler in the sheet of paper adheres to the fixation roller, although it is only by a minute amount. Then, as the fixation roller rotates further, the contaminants come into contact with the external heating member. Even if the external heating member is made slipperier than the fixation roller, paper dust and/or filler in the sheet of paper electrostatically and/or mechanically adheres to the external heating member. If the toner having adhered to the fixation roller adheres to the paper dust having adhered to the external heating member, the toner mixes with the paper dust. As the toner mixes with the paper dust, it loses its adhesiveness. Thus, it fails to transfer the contaminants on the external heating member onto the fixation roller. Consequently, the mixture collects on the external heating member.

The residual toner on the external heating member, that is, the toner having collected on the external heating member as described above, irregularly transfers back onto the fixation roller, and as it transfers back, it soils the image on the sheet. This has been the problem to be solved.

The present invention was made in consideration of the above-described problem. Thus, its primary object is to provide an image forming apparatus capable of completely removing the toner having collected on the heating member for heating the fixation roller.

SUMMARY OF THE INVENTION

According to an aspect of the present invention, there is provided an image forming apparatus for forming an unfixed toner image on a sheet; a fixing unit including a fixing roller, a back-up member for cooperating with the fixing roller to form a nip therebetween, and a rotatable heating member contactable to a surface of the fixing roller to heat the fixing roller; wherein the sheet is outputted from the apparatus after the unfixed toner image is fixed on the sheet, wherein the apparatus is operable in a cleaning mode for cleaning the fixing unit, wherein when the cleaning mode is selected, a predetermined unfixed toner image is formed on the sheet, and the sheet is fed to the fixing unit, and the toner is transferred from the sheet onto the fixing roller in the fixing nip, and then the toner transferred onto the fixing roller is brought into contact with the heating member, and thereafter, the toner on the fixing roller is transferred onto the sheet in the fixing nip.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. First, one of the image forming apparatuses in the preferred embodiments will be described.

Embodiment 1

Figure 1:
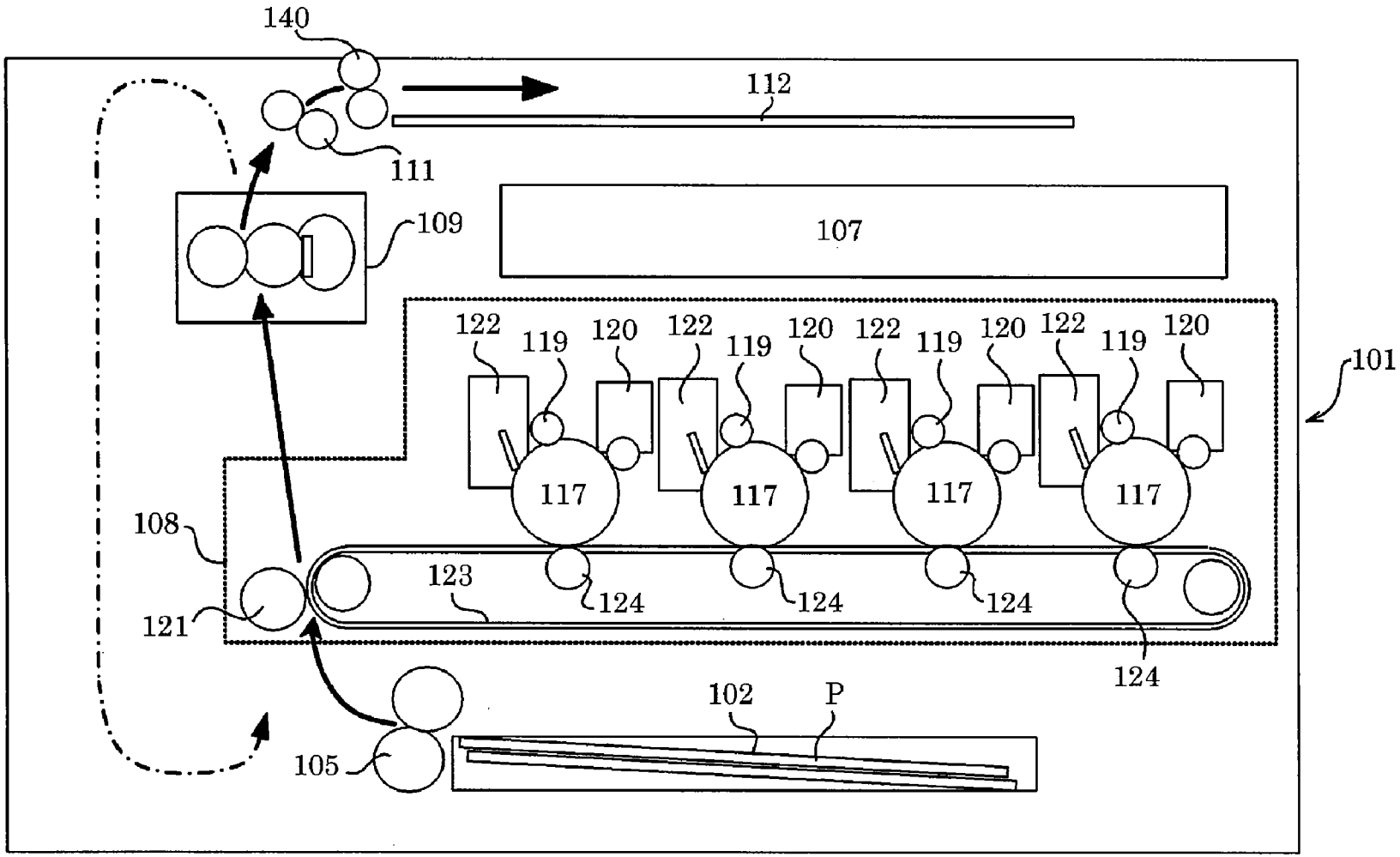
FIG. 1 is a sectional view of the image forming apparatus having a fixation unit, in the first embodiment of the present invention, and shows the general structure of the apparatus.

FIG. 1 is a schematic drawing of the image forming apparatus in the first embodiment of the present invention. The apparatus has a fixation unit. Incidentally, the drawing is a vertical sectional view of a laser beam printer as an example of an image forming apparatus in accordance with the present invention, and shows the general structure thereof.

(Overall Structure of Image Forming Apparatus)

The main assembly 101 of the laser beam printer (which hereafter will be simply referred to as main assembly 101) has a sheet feeder cassette 102, a pair of feeding-and-conveying rollers 105, etc. The sheet feeder cassette 102 is a cassette in which sheets of the recording media P are stored. The feeding-and-conveying rollers 105 are the rollers which pull out the sheets of the recording media P, one by one, from the sheet feeder cassette 102.

The main assembly 101 has also a laser scanner portion 107 and an image-forming portion 108, which are on the downstream side of the feeding-and-conveying rollers 105. The image forming portion 108 forms a toner image (unfixed) on a sheet of recording media P (which hereafter will be referred to simply as sheet P), with the use of a beam of laser light from the laser scanner portion 107. That is, the image forming means of the laser printer in this embodiment is made up of the laser scanner portion 107 and the image-forming portion 108. The image forming portion 108 is made up of a photosensitive drum 117, a charge roller 119, a developing device 120, a first transfer roller 124, a second transfer roller 121, a cleaner 122, an intermediary transfer member 123, etc., which are necessary for an electrophotographic process.

[Fixation Unit]

Figure 2:
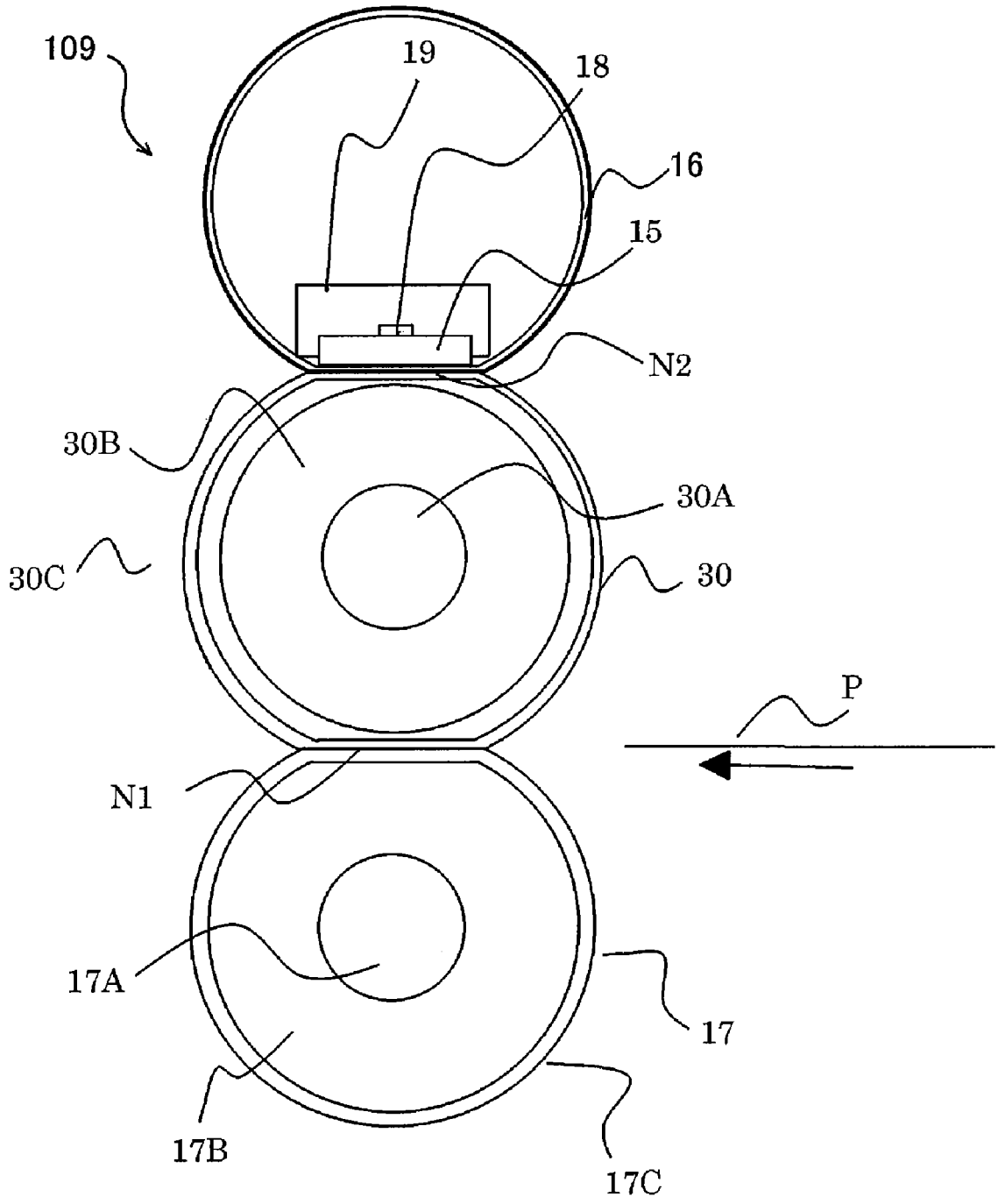
FIG. 2 is a sectional view of the fixation unit in the first embodiment of the present invention, and shows the structure of the unit.

Next, referring to FIG. 2, the fixation unit 109 of the printer will be described. FIG. 2 is a schematic sectional view of the fixation unit 109, and shows the structure thereof.

The fixation unit 109 has a fixation roller 30 and a pressure roller 17. The fixation roller 30 functions as a pressing member as well as a heating member. It is a member that is cylindrical, or roughly cylindrical, and is freely rotatable. The pressure roller 17 is a pressing member. It is cylindrical, or roughly cylindrical, and is freely rotatable. The fixation unit 109 fixes an unfixed toner image on a sheet of recording media to the sheet of the recording media by applying heat and pressure to the unfixed toner image while the sheet P and the unfixed toner image thereon are moved through the nip formed by the fixation roller 30 and the pressure roller 17. Further, the fixation unit 109 has an endless film 16 and a ceramic heater 15. The endless film 16 is a heating member for heating the fixation roller 30 by being placed in contact with the peripheral surface of the fixation roller 30. It is circularly driven. More specifically, heat is applied from the ceramic heater 15 as a heating means to the fixation roller 30 through the film 16. The temperature of the ceramic heater 15 is detected by a thermistor as a temperature-sensing member (which hereafter will be referred to simply as thermistor 18).

The ceramic heater 15 and the fixation roller 30 form a fixation roller heating nip N2 by being pressed against each other by an unshown pressing means, with the presence of the film 16 between the heater 15 and the fixation roller 30. Further, the fixation roller 30 and the pressure roller 17 form a fixation nip N1 by being pressed against each other by an unshown pressing member.

The ceramic heater 15 of the fixation unit 109 is supported by a holder 19 attached to the main assembly of the fixation unit 109.

Figure 3:
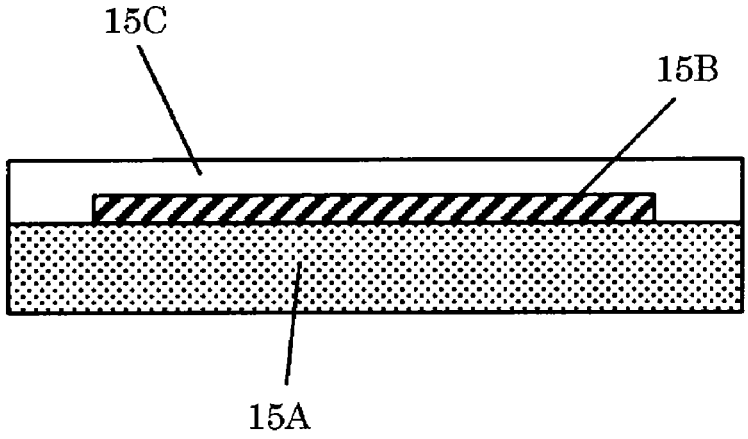
FIG. 3 is a sectional view of the ceramic heater in the first embodiment of the present invention, and shows the general structure of the heater.

Referring to FIG. 3, the ceramic heater 15 is made up of a substrate 15A and a heat generating resistor 15B. The substrate 15A is a piece of a thin plate, the primary ingredient of which is a ceramic such as alumina, aluminum nitride, or the like. The heat generating resistor 15B is on one of the primary surfaces of the substrate 15A. Its primary ingredient is silver, palladium or the like. The aforementioned thermistor 18 is in contact with the opposite surface of the substrate 15A from the surface on which the heat generating resistor 15B is present. The first surface of the substrate 15A is covered with a protective layer 15C to protect the surface from the film 16, which slides on the surface. The main ingredient of the protective layer 15C is glass, or a heat resistance resin such as fluorinated resin, polyimide, or the like. Incidentally, FIG. 3 is a schematic sectional view of the ceramic heater 15, and shows the general structure thereof.

Figure 4:
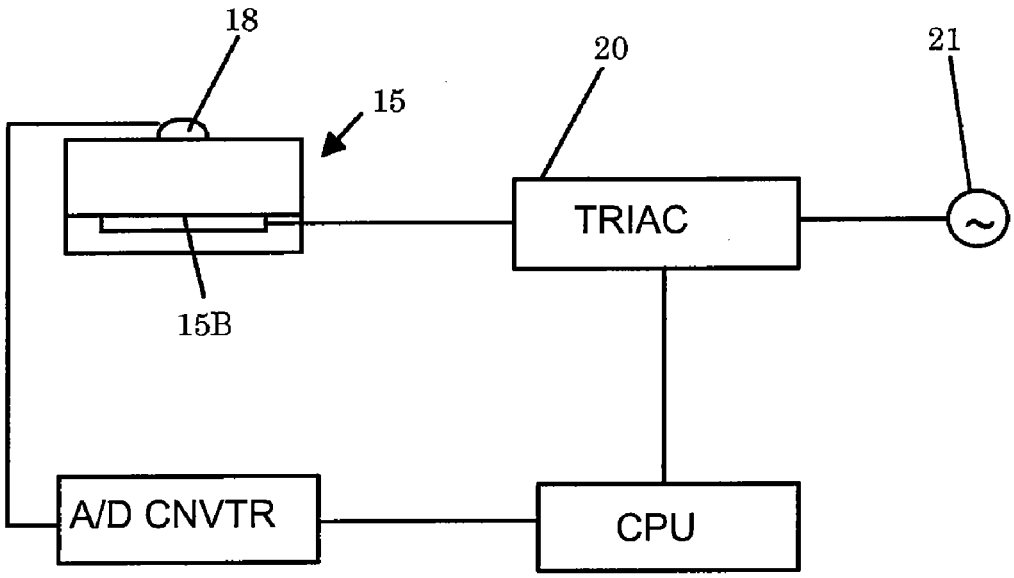
FIG. 4 is a block diagram that shows the connection between the ceramic heater and the means adjacent thereto.

Referring to FIG. 4, the fixation unit 109 is structured so that the heat generating resistor 15B, which makes up the ceramic heater 15, receives electric power from a commercial electric power source 21 through a triac 20. As the heat generating resistor 15B receives electric power from the commercial electric power source 21, it generates heat, thereby heating the fixation roller 30 through the film 16.

Next, referring to FIG. 2, the film 16 of the fixation unit 109 is made so that in terms of its rotational direction, the dimension of its inward surface is slightly greater by a preset value than the peripheral surface of the film holder 19. Thus, the film 16 is allowed to remain fitted around the holder 19 without being tensioned by the holder 19. The fixation unit 109 is structured so that as the fixation roller 30 is rotationally driven by a driving mechanism (unshown), which is outside the main to assembly of the fixation unit 109, the film 16 is circularly driven by the rotation of the fixation roller 30 while being guided by the holder 19 in a preset direction.

Further, the film 16 is laminated. That is, it is made of two endless films laminated to each other. The main ingredient of one of the endless film is polyimide, and the main ingredient of the other is PFA. The latter is on the outward surface of the former.

The fixation roller 30 of the fixation unit 109 is made of a metallic core 30A, an elastic layer 30B, and a slippery layer 30C. The metallic core 30A is cylindrical or roughly cylindrical, and is formed of iron, SUS, aluminum, or the like. The elastic layer 30B is on the peripheral surface of the metallic core 30A, and its main ingredient is silicone rubber, or the like. The slippery layer 30C, which is the outermost layer, is on the outward surface of the elastic layer 30B, and its main ingredient is PTFE, PFA, FEP, or the like. The fixation unit 109 is structured so that the fixation roller 30 is rotationally driven by the driving force transmitted to one of the lengthwise ends of the shaft of the metallic core 30A from the driving mechanism.

The pressure roller 17 of the fixation unit 109, which functions as a member for backing up recording media, is made up of a metallic core 17A, an elastic layer 17B, and a slippery layer 17C. The metallic core 17A is cylindrical or roughly cylindrical, and is formed of aluminum, or the like. The elastic layer 17B is on the peripheral surface of the metallic core 17A, and its main ingredient is silicone rubber, or the like. The slippery layer 17C, which is the outermost layer, is on the outward surface of the elastic layer 17B, and its main ingredient is PTFE, PFA, FEP, or the like. The fixation unit 109 is structured so that the pressure roller 17 is rotationally driven by the rotation of the fixation roller 30.

At this time, referring to FIGS. 1 and 4, the operation of the fixation unit 109 and that of the image forming apparatus will be described. As the unshown controller of the main assembly 101 receives a print signal, the fixation roller 30 is rotationally driven, and therefore, the film 16 and the pressure roller 17 are rotated by the rotation of the fixation roller 30.

Further, electric power is sent to the ceramic heater 15 while being controlled so that the temperature of the ceramic heater 15, which is detected by the thermistor 18, reaches a preset target level.

The peripheral surface of the fixation roller 30 is heated by the ceramic heater 15 through the film 16 until its temperature reaches a preset level. The surface temperature of the film 16 remains lower than the temperature of the ceramic heater 15. Further, the surface temperature of the fixation roller 30 remains lower than that of the film 16. The surface temperature of the pressure roller 17 remains even lower than that of the fixation roller 30. As long as the ceramic heater 15 is being supplied with electric power, this thermal relationship, in terms of temperature level, among the abovementioned components, always remains the same, because the fixation unit 109 is structured so that the ceramic heater 15 is the primary heat source.

In a case where the image forming apparatus is started after the fixation unit has cooled down, the temperature differences among these components are greater than in a case where the image forming apparatus is started before the fixation unit has not cooled down. That is, after the fixation nip of the fixation unit 109 became hot enough for fixation, the temperature difference is not as much as immediately after the starting of the image forming apparatus after the fixation unit has cooled down.

The sheets P in the sheet feeder cassette 102 are pulled out one by one from the sheet feeder cassette 102 by the pair of conveyance rollers 105, and are sent to a pair of registration rollers 106. Then, each sheet P is conveyed to the image-forming portion 108 by the registration rollers 106.

Then, an unfixed toner image is transferred onto the sheet P in the image-forming portion 108. Then, the sheet P is introduced into the fixation nip N1 of the fixation unit 109.

(Hot Offset)

After the introduction of the sheet P into the fixation nip N1, the sheet P is conveyed between the fixation roller 30 and pressure roller 17, which have increased in temperature to a preset fixation level by being heated by the heat from the ceramic heater 15 through the film 16, while remaining pinched by the two rollers 30 and 17. While the sheet P is conveyed through the fixation nip N1, the abovementioned unfixed toner is melted, and becomes permanently fixed to the sheet P. After the fixation of the unfixed image to the sheet P in the fixation nip N1, the sheet P is conveyed further by a pair of discharge rollers 111, and discharged from the main assembly of the image forming apparatus into an external delivery tray 112 by a pair of discharge rollers 140.

In a case where an excessive amount of heat is given to the toner (image) on the sheet P in the fixation nip N1, some toner particles are excessively melted, and some of the excessively melted toner particles transfer onto the fixation roller 30. Hereafter, this phenomenon will be referred to as "hot offset".

Figure 5:
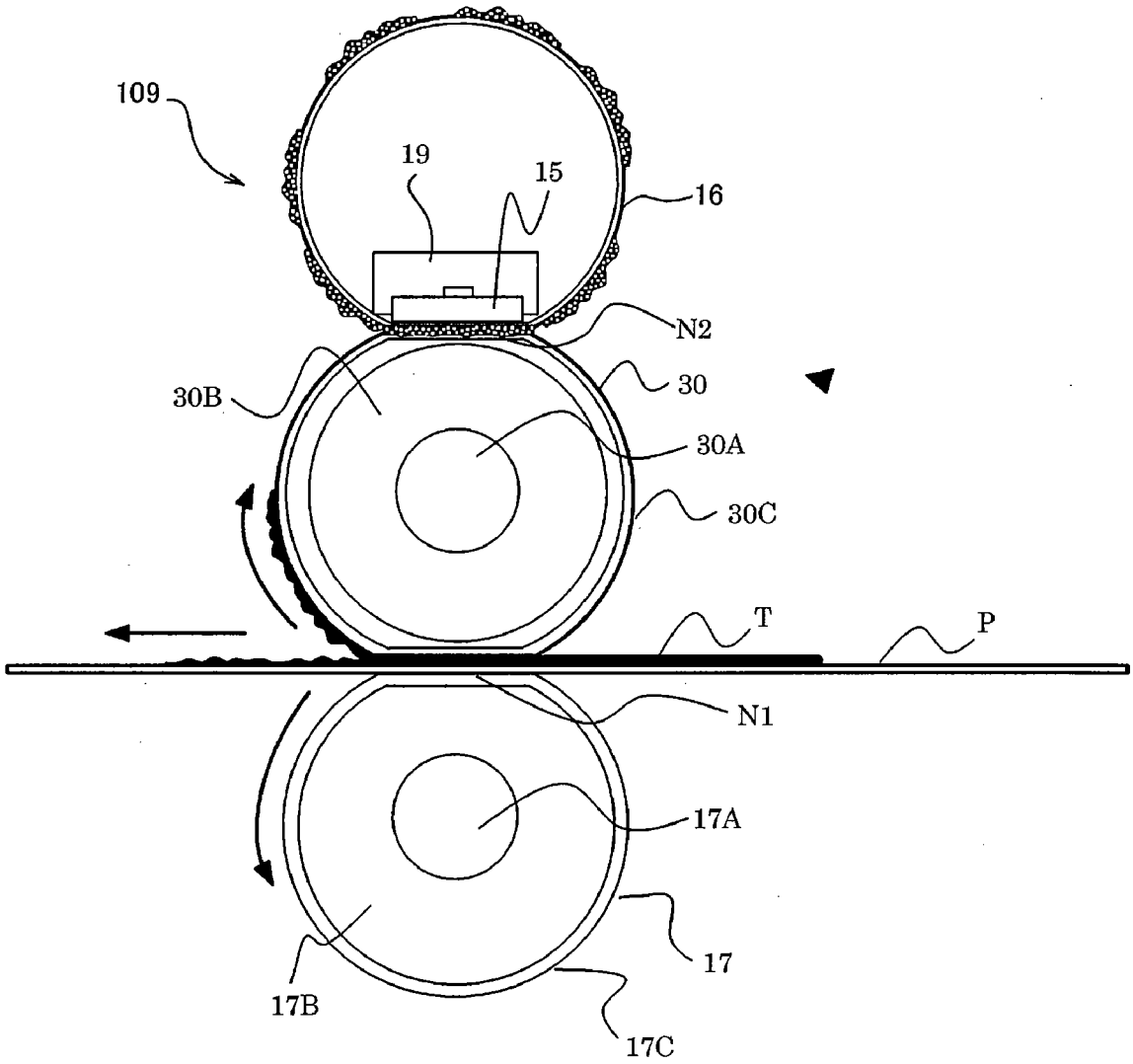
FIG. 5 is a schematic drawing for describing the "hot offset" of toner, which occurs in the fixation nip.

Next, referring to FIG. 5, as toner is excessively melted, it is reduced in agglutinability. Thus, the toner layer on the sheet P separates into a sub layer of toner which is in contact with the sheet P, and a sub layer of toner which is in contact with the fixation roller 30. The former sublayer tends to adhere to the sheet P, whereas the latter sublayer tends to adhere to the fixation roller 30. Consequently, the toner image on the sheet P is partially fixed to the sheet P, and the portion of the toner image, which failed to be fixed to the sheet P, transfers onto the fixation roller 30. In other words, "hot offset" occurs. As "hot offset" occurs, the toner having transferred onto the fixation roller 30 transfers back onto the sheet P after a full rotation of the fixation roller 30. That is, the image bearing surface of the sheet P becomes contaminated with the toner having transferred back onto the sheet P.

On the other hand, if the amount of heat applied to the toner image on the sheet P in the fixation nip N is insufficient, the toner in the toner image fails to be fully melted, failing therefore to be satisfactorily fixed to the sheet P. Thus, some toner in the toner image separates from the sheet P, thereby reducing the toner image in quality and/or soiling the hands of a user, after the discharging of the sheet P from the apparatus.

When the image forming apparatus is in the ordinary fixation mode, the target level for fixation temperature is set so that the sheet P and the toner image thereon are given the proper amount of heat, that is, an amount which is smaller than an amount Qh beyond which "hot offset" occurs, but greater than an amount Q1 below which the toner image is insufficiently fixed. With the target level for the fixation temperature set as described above, the toner in the toner image on the sheet P is given a proper amount Qn of heat, and therefore, the toner is satisfactorily fixed to the sheet P.

The amount Qn, which does not cause "hot offset" nor under-fixation, and the target level for fixation temperature, are affected by the amount of the toner on the sheet P, and the toner type. Further, how the toner on the sheet P melts at the interface between the body of toner on the sheet P and the sheet P is affected by the basis weight and surface properties of the sheet P. They are also affected by the environment in which the image forming apparatus is used. Thus, the image forming apparatus (fixation unit 109) is designed so that the target level for fixation temperature is switched according to the type of the sheet P, the toner type, and the environment, in order to give heat to the toner image on the sheet P by the amount Qn, that is, the proper amount.

As described above, when the image forming apparatus performs ordinary fixation, the fixation temperature is controlled to prevent the occurrence of "hot offset". However, in such a case as where "hot offset" has occurred due to the usage of an improper sheet (P) for the image forming apparatus, it is possible that as the fixation roller 30 rotates, the toner having adhered to the fixation roller 30 will transfer onto the film 16.

In this embodiment, therefore, it is desired that the strength of adhesion between slippery layer of the film 16 and the toner is less than that between the slippery layer 30C of the fixation roller 30 and toner.

One of the methods for adjusting a slippery layer in slipperiness is as follows: a substance such as an inorganic filler, which is inferior in terms of slipperiness, is dispersed in a material such as PTFE, PFA, FEP, or the like, which is the main ingredient of the slippery layer, to chemically adjust the material for the slippery layer in slipperiness. Further, the slippery layer may be adjusted in surface roughness by controlling the condition under which the slippery layer is formed.

The slipperiness of each of the slippery layers is expressed in terms of the likeliness with which toner adheres to the slippery layer after the fixation unit has fully warmed up for fixation and the toner has been melted enough to "hot offset".

(Method for Testing Slippery Layer in Effectiveness)

Next, a method for testing the slippery layer in effectiveness in terms of the prevention of toner adhesion will be described. First, the heater 15 of the fixation unit 109 is increased in temperature to a preset level. Then, the fixation roller 30 and pressure roller 17 are rotated. The target level is a level high enough to cause the toner on the sheet P to "hot offset" in the fixation nip N1. The fixation unit 109 is warmed up by keeping the temperature of the heater 15 at this target level for five minutes.

As soon as the fixation unit is sufficiently warmed up, the electric power supply to the heater 15, and the rotational driving of the fixation roller 30 and pressure roller 17 are temporarily stopped. Then, while the fixation unit is remains sufficiently warm for fixation, unfixed toner is moved into the nip N1, that is, the nip for fixation, and the nip N2, that is, the nip for heating the fixation roller 30. It is desired that the length of time they are temporarily stopped is no more than 30 seconds, preferably, no more than 10 seconds. Then, the electric power supply to the heater 15, and the rotation of the fixation roller 30 and pressure roller 17, are restarted. As they are restarted, the toner which was in the fixation nip N1 transfers onto the fixation roller 30 or the pressure roller 17. The toner that was in the fixation roller heating portion N2 transfers from the fixation roller 30 onto the film 16. Here, if a first component is greater in the amount by which toner has transferred thereto and adhered thereto than a second component, the first component is considered to be inferior in terms of slipperiness than the second component.

Generally speaking, if a first object is smaller in surface energy and less rough across its surface than a second object, toner is less likely to adhere to the first object than the second object. Further, if melted toner is sandwiched between two objects that are different in temperature, the melted toner is likely to transfer onto the object that is lower in temperature, because the portion of the body of melted toner, which is in contact with the object that is lower in temperature increases in viscosity, increasing therefore in adhesiveness.

The amount of slipperiness between two objects, which is obtained through the above described slipperiness test, is affected by the material of each object and the temperature of each object.

However, the above described slipperiness test is carried out after the fixation unit has been warmed up for a long time, and therefore, has reached its thermal equilibrium. In other words, it is carried out when the temperature differences among the aforementioned components are relatively small. However, when the image forming apparatus in this embodiment is in the cleaning mode, the ordinary fixation mode, or the like, the fixation unit is not warmed up for a long time, and therefore, the difference in surface temperature among the film 16, the fixation roller 30 and the pressure roller 17 is greater than when the slipperiness test is carried out. If the film 16 is slipperier than the fixation roller 30 in the above-mentioned slipperiness test, the film 16 will be even more slippery than the fixation roller, when the image forming apparatus is in the cleaning mode or ordinary fixation mode.

(Cleaning Mode)

Figure 6:
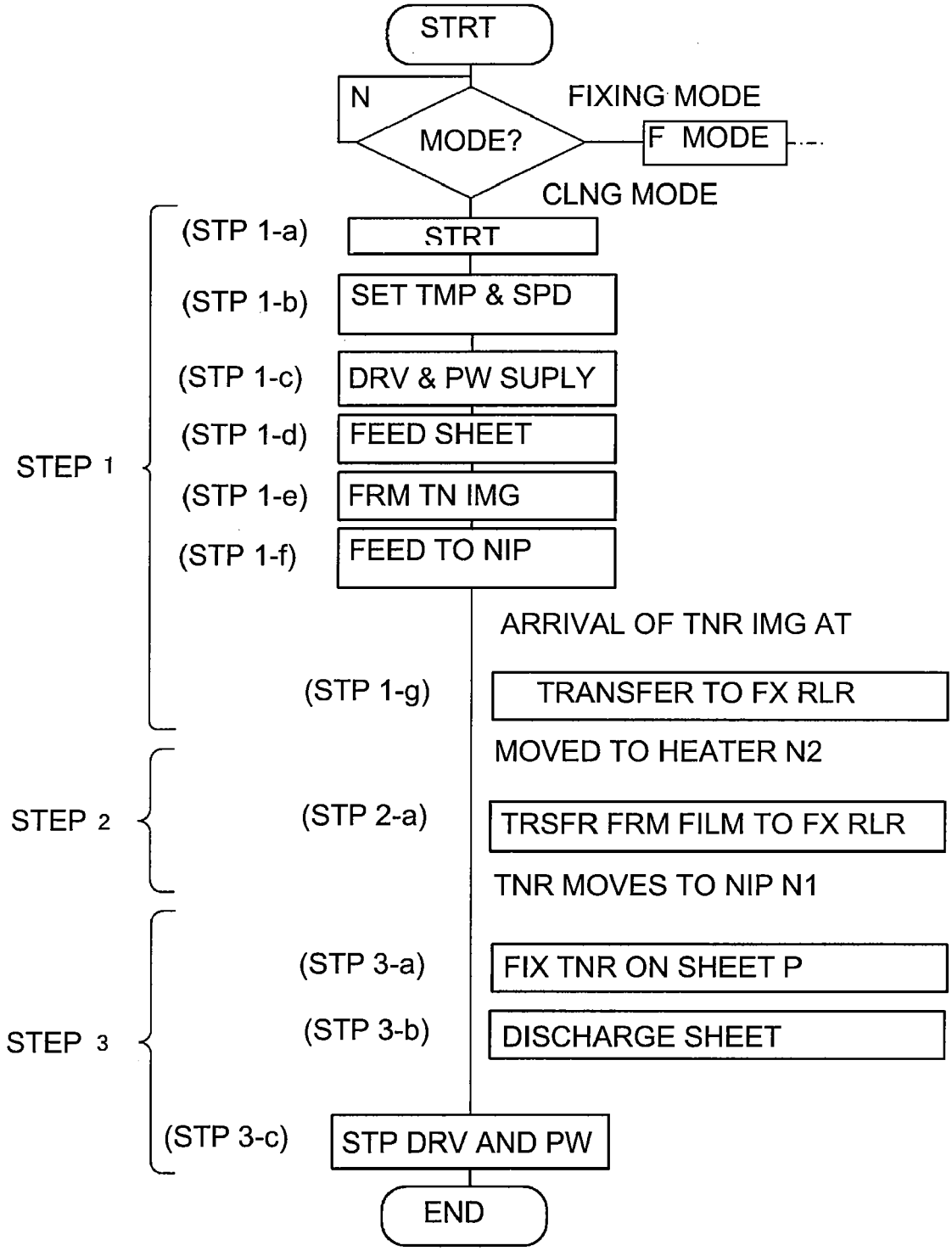
FIG. 6 is a flowchart of the cleaning operation in the first embodiment of the present invention.
Figure 7:
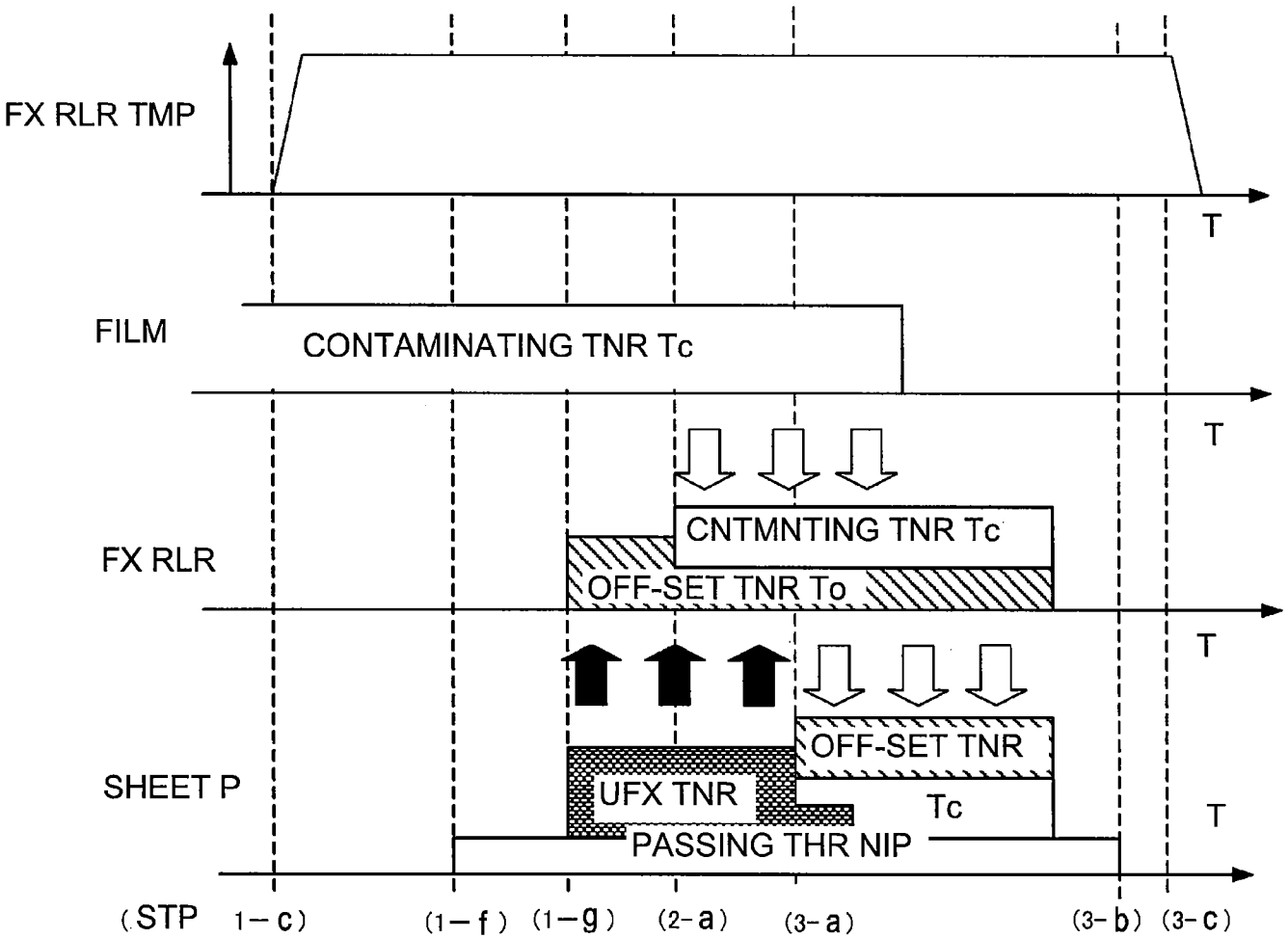
FIG. 7 is a graphic time chart for showing the toner movements or the like in the first embodiment.

Next, referring to FIGS. 6 and 7, the cleaning of the fixation unit will be described. FIG. 6 is a flowchart that shows the operation of the image forming apparatus. FIG. 7 is a graphical timetable that shows the toner movements on the sheet P, the fixation roller 30, and the film 16, and the changes in the temperature of the fixation roller 30.

Hereinafter, the ordinary operational mode of the fixation unit is referred to as "fixation mode" and the operational mode of the fixation unit, which is for cleaning, is referred to as "cleaning mode".

In the cleaning mode, the following three steps are consecutively carried out.

1) First step: the unfixed toner on the sheet P is transferred onto the fixation roller 30.

2) Second step: the toner on the film 16 is removed with the use of the toner on the fixation roller 30.

3) Third step: the toner on the fixation roller 30 is transferred onto the sheet P, and then, is fixed to the sheet P.

The toner on the film 16 is transferred onto the sheet P through the above-described three steps, and then, is discharged with the sheet P. Next, each of the abovementioned three steps will be concretely described.

(First Step)

First, the step for transferring the unfixed toner on the sheet P, onto the fixation roller 30 will be described.

As a user determines that the fixation unit needs cleaning, the user is to switch the image forming apparatus in operational mode from the fixation mode to the cleaning mode, by inputting an operational mode switching signal through the control panel of the main assembly 101, or an unshown host computer, while the image forming apparatus is kept on standby (Step 1-*a*). Incidentally, the image forming apparatus may be designed so that print count is kept by the apparatus main assembly 101, and as the print count reaches a preset value, the control portion of the apparatus main assembly 101 determines that the cleaning is necessary, and automatically switches the image forming apparatus from the fixation mode to the cleaning mode.

As the image forming apparatus begins to be operated in the cleaning mode, the target level for the temperature of the ceramic heater 15 of the fixation unit 109 is set to the temperature level for the cleaning mode. Further, the process speed of the image forming apparatus is set for the cleaning mode (Step 1-*b*).

Then, the image forming apparatus begins to be operated at the preset speed for the cleaning, and the fixation roller 30 begins to be driven, with its temperature set to the target level for cleaning. Further, electric power begins to be sent to the heater 15 (Step 1-*c*). In the cleaning mode in this embodiment, the target temperature level for the fixation unit, and the process speed of the image forming apparatus, are set so that it is ensured that "hot offset" will occur.

In other words, in the cleaning mode, the target temperature is set higher than in the fixation mode so that the amount of heat Qh is given to the toner on the sheet P (second amount) which is large enough to cause "hot offset" and is greater than the amount Qn, that is, the amount of heat given to the toner on the sheet P when the image forming apparatus (fixation unit) is in the fixation mode. It is desired that in the cleaning mode, the target temperature level is changed according to the sheet type (recording medium type), the environment in which the apparatus is operated, and/or the like factors, so that even if the condition under which the image forming apparatus is operated changes, it is ensured that "hot offset" will occur. Instead, the image forming apparatus may be limited in the type of sheet of recording media that is to be used in the cleaning mode.

In the cleaning mode, the image forming apparatus may be controlled so that its process speed is switched to the one for the cleaning mode, and the toner on the sheet P can be given the amount of heat Qh which is large enough to cause "hot offset". The slower the process speed, the longer the time available for transmitting heat from the fixation roller 30 to the toner on the sheet P in the fixation nip N1. Therefore, even if the target temperature of the fixation unit is kept unchanged, the amount of heat given to the toner increases.

In terms of size, the sheet P for cleaning is desired to be largest in width among various sheets of the recording media usable with the image forming apparatus. Here, the width of the sheet P is the dimension of the sheet P in terms of the direction perpendicular to the sheet conveyance direction. Further, the sheet P for cleaning is desired to be larger in width than the sheets P that have been used before the cleaning operation, because it is possible that contaminants might have adhered to the film 16 across the entire portion of the film 16 which came in contact with the sheets P used before the cleaning operation.

Next, the image forming apparatus is made to start an image forming operation. Thus, the sheet P is pulled out of the sheet feeder cassette 109, and is conveyed to the image forming portion 108, by the pair of feed-and-conveyance rollers 105 (Step 1-*d*). Then, an image having a pattern for the cleaning mode is formed on the sheet P by the image forming portion 108 (Step 1-*e*). Incidentally, an example of the image pattern for the cleaning mode is shown in shown in FIG. 8.

The image to be formed on the sheet P for the cleaning mode is desired to be a solid image that is as wide as possible in terms of the direction perpendicular to the sheet conveyance direction. In terms of the direction parallel to the sheet conveyance direction, it is desired to be longer than the external circumference of the film 16. In terms of print ratio, it is desired to be in a range of 50%-300%, preferably, 70%-200%.

Here, "print ratio" is not simply the ratio between the portion of the sheet P covered with toner and the portion of the sheet P that is not covered with toner. It means such a ratio that reflects the density of each dot as well. That is, "print ratio" is the percentage of the number of the picture elements to be exposed, relative to the entire number of entire picture elements of which an image is formed based on image formation data (exposed picture element/entire picture element)×100. It corresponds to the value obtained by integrating the density (toner amount) of each picture element, which is adjusted by pulse width modulation (PWM).

Regarding the definition of "print ratio", in the case of an image forming apparatus which reproduces 256 levels of gradation, for example, by PWM, the density of each picture element can be expressed in the form of a fraction, for example, x/256, or a percentage obtained by converting the fraction into percentage. For example, assuming that the print ratio of a monochromatic solid image is 100%, if the optical density of an image is 50% relative to the solid image, the print ratio of the image is 50%, and a solid image of a secondary color, such as blue (color of the area where a solid magenta image and a solid cyan image overlap) is 200%.

If an image on the sheet P is no more than 50% in print ratio, the portion of the sheet P, which is covered with toner, is smaller than the portion of the sheet P, which is not covered with toner. Therefore, the amount of the toner that can be adhered to the peripheral surface of the fixation roller 30 is smaller. If the amount of the toner adhering to the peripheral surface of the fixation roller 30 is smaller than a certain value, the slipperiness of the peripheral surface of the fixation roller 30 overwhelms the adhesion between the body of toner on the fixation roller 30 and the peripheral surface of the fixation roller 30, making it therefore difficult to clean the fixation unit. On the other hand, if the print ratio is no less than 300%, the sheet P is excessive in the amount of the toner thereon, making it therefore difficult to cause "hot offset".

The image pattern for the cleaning sheet P is desired to be such that an image resulting from the pattern has a white black space across the leading edge portion of the sheet P, so that the portion of the image, from which toner is to be "hot offset", will enter the fixation nip N1 after the leading edge portion of the sheet P enters the nip between the pair of discharge rollers 111. Creating the image pattern for the cleaning sheet P as described above can prevent the cleaning sheet P from wrapping around the fixation roller 30. Further, the image pattern is desired to be such that the cleaning sheet P resulting from the pattern will have a blank space also across its trailing end portion, in order to prevent toner from "hot offsetting" onto the fixation roller 30 by an amount greater than the amount equivalent to the circumference (single full rotation) of the fixation roller 30.

Figure 9:
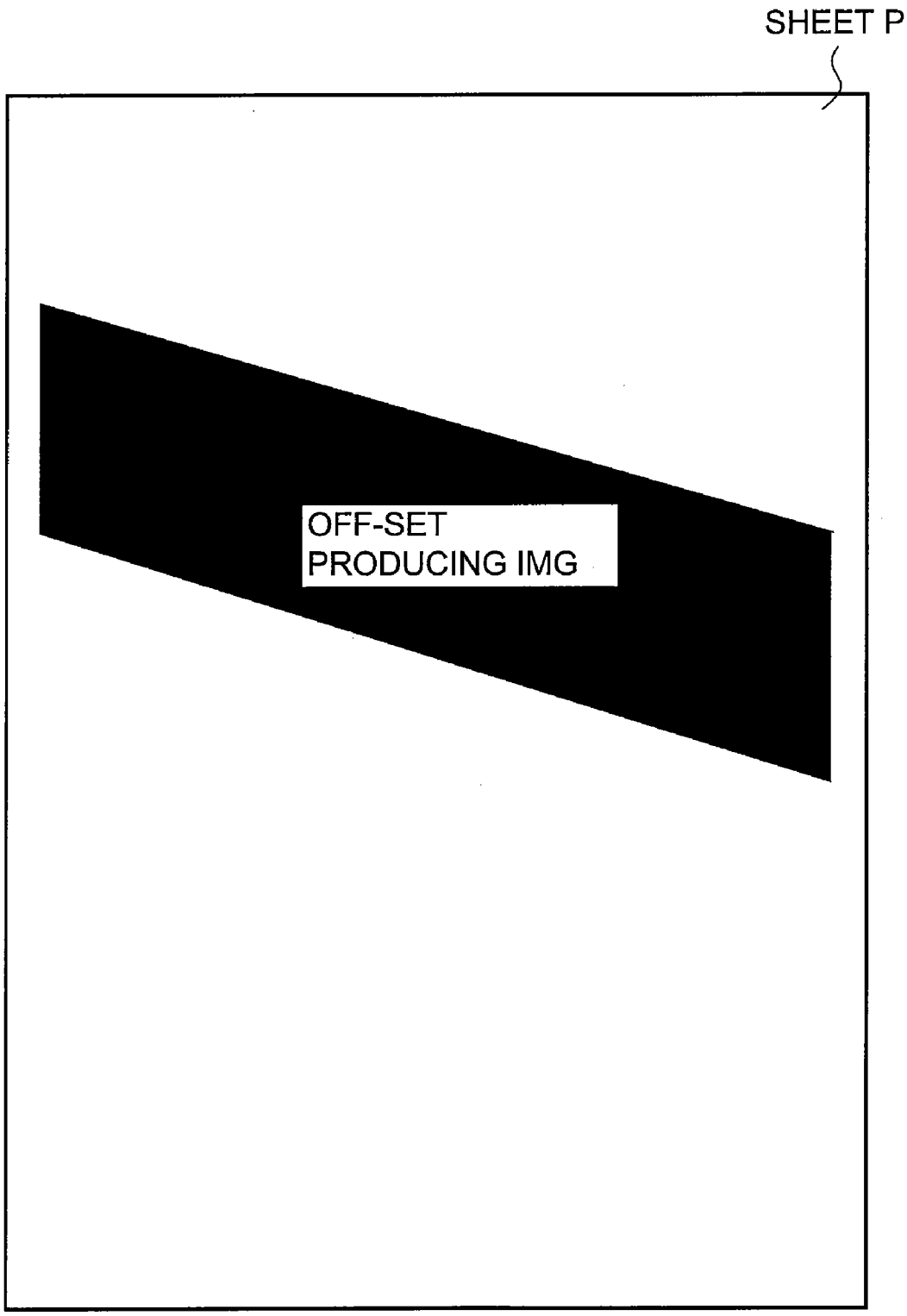
FIG. 9 is an example of the modification of the toner image for cleaning, in the first embodiment.

Referring to FIG. 9, the image pattern for the formation of a cleaning sheet may be designed so that the unfixed toner image will be diagonally placed on the sheet P. In the case of this image pattern, as the cleaning sheet is conveyed through the fixation nip N1, the unfixed toner image gradually offsets. Therefore, the adhesion between the toner image and the fixation roller 30 is less than in the case where the toner image offsets all at once across its entire range in terms of the width direction of the sheet P. Thus, it is even less likely for the cleaning sheet (P) to wrap around the fixation roller 30.

The cleaning sheet, or the sheet P on which the unfixed toner image is present, is introduced into the fixation unit 109 (Step 1-*f*).

Then, the unfixed toner image on the sheet P reaches the fixation nip N1, and is conveyed through the fixation nip N1. As the sheet P is conveyed through the fixation nip N1, a part of the toner in the unfixed toner image on the sheet P is "hot-offset" onto the fixation roller 30 (Step 1-*g*). Hereafter, the toner having transferred onto the fixation roller 30 will be referred to as offset toner To.

(Second Step)

Next, the process for cleaning the contaminant toner on the film 16 (toner having adhered to the film 16, and will be referred to as contaminant toner Tc hereafter), with the utilization of the offset toner To on the fixation roller 30 will be described.

Figure 10:
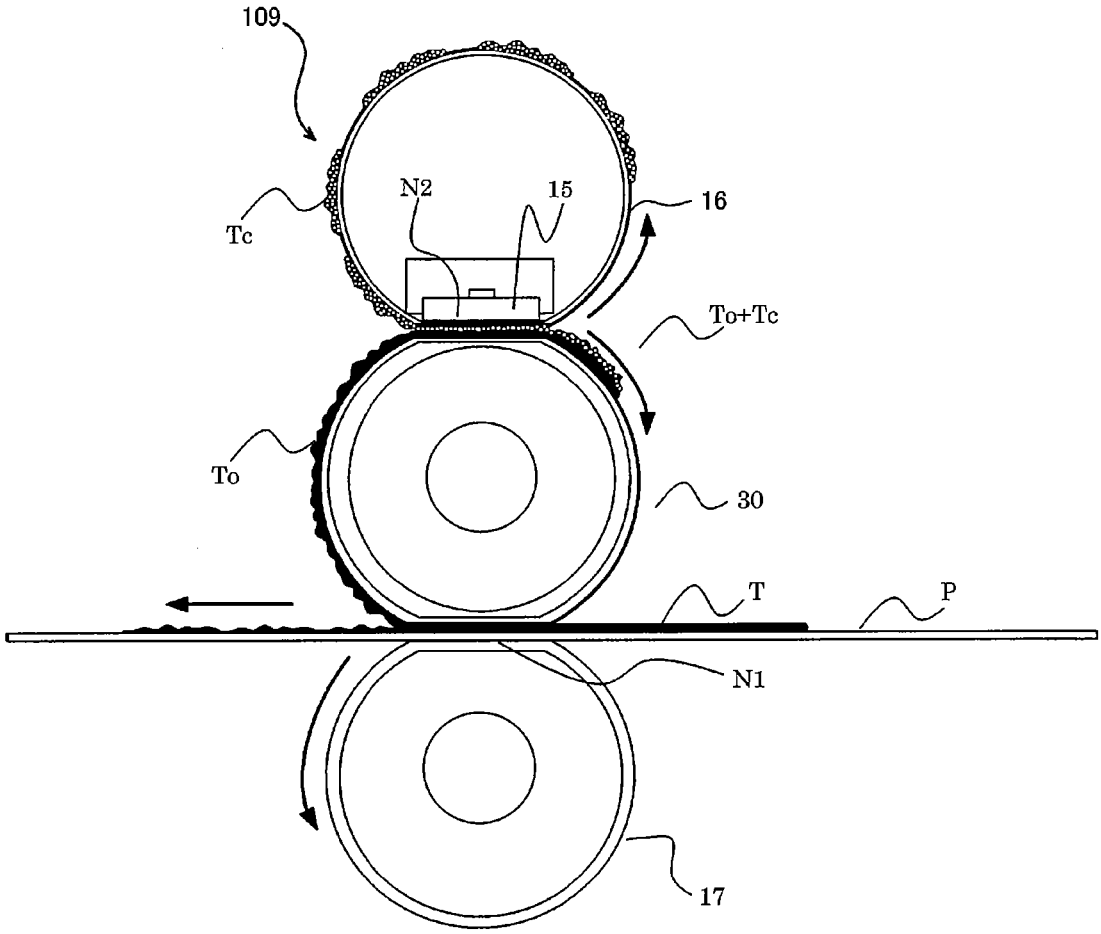
FIG. 10 is a schematic drawing for describing the process for transferring the contaminant toner on the heating film, onto the fixation roller.

As the fixation roller 30 rotates, the offset toner To, that is, the toner having transferred ("hot offset") onto the fixation roller 30, reaches the fixation roller heating nip N2, in which it comes into contact with the film 16. Next, referring to FIG. 10, the contaminant toner Tc on the film 16 is transferred onto the fixation roller 30 by the adhesiveness of the offset toner To (Step 2-*g*). Incidentally, FIG. 10 is a schematic sectional view of the fixation unit when it is performing Step 2.

Here, the mechanism of the transfer of the contaminant toner Tc on the film 16 onto the fixation roller 30 will be described.

The contaminant toner Tc on the film 16 is a mixture of resinous toner particles, and paper dust consisting of pieces of fibers of which the sheet P is made, and fillers made of inorganic substances such as calcium carbonate, talc, etc. Therefore, it is difficult to thermally soften, and also, it is low in adhesiveness.

This paper dust separates (fall) from the sheet P when the sheet P is heated for the fixation operation. As they separate, they adhere to the fixation roller 30. Then, they come into contact with the film 16 in the fixation roller heating nip N2. Even if the film 16 is made slipperier than the fixation roller 30, the paper dust and the like electrostatically and mechanically adhere to the film 16. To this small amount of paper dust made up of inorganic substances, a small amount of toner adheres, thereby turning into the contaminant toner Tc.

The contaminant toner Tc is a mixture of two types of toner particles. One type of toner particles is the type that adhered to the surface of the film 16 and are solidified thereon. The other type of toner particles is the type that transferred onto the surface of the film 16, but did not solidify, and yet, lack adhesiveness. Thus, they do not firmly adhere to the film 16, or to the fixation roller 30, therefore remaining on the film 16.

Those having solidified and firmly adhered to the film 16 do not easily separate (fall) from the film 16, and therefore, do contribute to the formation of an unsatisfactory image. On the other hand, those having not completely solidified and remaining on the film 16 because of the presence of a small amount of adhesiveness between them and film 16, irregularly transfer back onto the fixation roller 30, thereby contributing to the formation of unsatisfactory images.

The toner particles in the contaminant toner Tc, which remain on the film 16 because of the presence of the small amount of adhesiveness between them and film 16, can be removed from the film 16 by operating the image forming apparatus in this embodiment in the cleaning mode.

Immediately after the offsetting, a large amount of contaminants such as paper dust have not adhered to the offset toner To, and therefore, the offset toner To is sufficiently adhesive to adhere to fixation roller 30, which is less slippery than the film 16, in the fixation roller heating nip N2. Thus, the offset toner To continues to adhere to the fixation roller 30. In other words, the portion of the contaminant toner Tc, which is on the film 16 only because of the presence of a small amount of adhesiveness between this portion and the film 16, can be transferred onto the fixation roller 30 with the utilization of the adherence between the offset toner To on the fixation roller 30, and the contaminant toner Tc on the film 16.

If the film 16 is slipperier than the fixation roller 30, in the fixation roller heating nip N2, most of the offset toner To is retained by the fixation roller 30.

However, the offset toner To is not very agglutinative. Therefore, it sometimes occurs that a part of the offset toner To adheres to the film 16. This phenomenon is likely to occur if the difference in slipperiness between the film 16 and the fixation roller 30 is small. In such a case, as the film 16 rotates, the offset toner To having adhered to the film 16 returns to the fixation roller heating nip N2, and comes into contact with the fixation roller 30 again. In other words, most of the offset toner To having adhered to the film 16 returns to the fixation roller 30. Moreover, as the fixation roller 30, and the offset toner To on the film 16, come into contact with each other the next time, most of the rest of the offset toner To returns to the fixation roller 30. Eventually, therefore, the offset toner To having adhered to the film 16 returns to the fixation roller 30 almost entirely.

(Third Step)

Next, the third step, or the step in which the toner on the fixation roller 30 is transferred onto the sheet P, and fixed to the sheet P, will be described.

Figure 11:
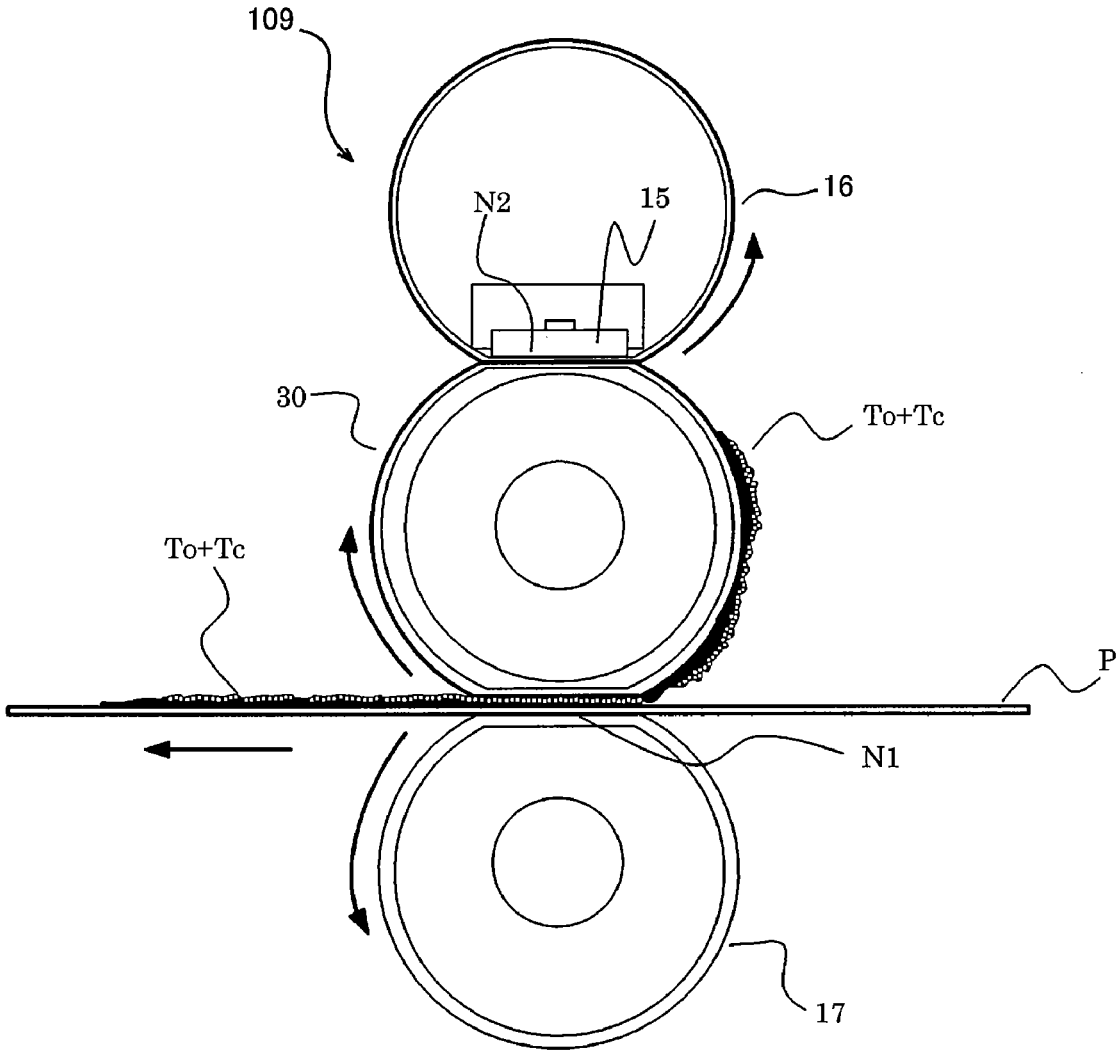
FIG. 11 is a schematic drawing for describing the process for transferring the contaminant toner on the fixation roller, onto a sheet of the recording media.

FIG. 11 is a schematic sectional view of the fixation unit when the fixation unit is in the third step. As will be evident from FIG. 11, as the fixation roller 30 rotates, the offset toner To and the contaminant toner Tc on the fixation roller 30 return to the fixation nip N1, in which they come into contact with the sheet P, and are fixed to the sheet P (Step 3-*a*).

If a large amount of the contaminant toner Tc is on the fixation roller 30, and/or the sheet P is inferior in surface properties, the entirety of the offset toner To and the contaminant toner Tc on the fixation roller 30 fail to be fixed. Thus, it sometimes occurs that a part of the offset toner To and/or a part of the contaminant toner Tc remains on the fixation roller 30 and passes the fixation nip N1 without being fixed.

As the fixation roller 30 rotates further, the offset toner To remaining on the fixation roller 30 reaches the fixation roller heating nip N2 again. However, the film 16 is slipperier than the fixation roller 30. Therefore, it seldom occurs that the offset toner To on the fixation roller 30 transfers onto the film 16. Besides, even if a part of the offset toner To on the fixation roller 30 transfers onto the film 16, it transfers back onto the fixation roller 30 during the following several full rotations of the fixation roller 30. As for the contaminant toner Tc, it remains adhered to the offset toner To on the fixation roller 30. Therefore, it seldom transfers onto the film 16. Then, the further rotation of the fixation roller 30 makes the toner on the fixation roller 30 return to the fixation nip N1, in which the toner on the fixation roller 30 is fixed to the sheet P. Even if it fails to be fixed all at once, it is eventually fixed during the following several full rotations of the fixation roller 30.

Thereafter, the sheet P is discharged into the delivery tray 112 by way of the pair of discharge rollers 111 and pair of discharge rollers 140. As the contaminant toner Tc on the film 16 is put through the above-described sequential steps, it is transferred onto the sheet P by way of the fixation roller 30, and then, is discharged with the sheet P from the apparatus main assembly 101 (Step 3-*b*). Then, the driving of the image forming apparatus, and sending of electric power to the heater, are stopped to end the operation in the cleaning mode (Step 3-*c*).

The steps described above are sequentially started. However, it takes a certain length of time from the starting of each step to the completion of the step. Therefore, the steps partially overlap. For example, Step 2-*a* begins in the fixation roller heating nip N2 before Step 1-*g* ends in the fixation nip N1. Further, in a case where the length of the unfixed image is greater than the length of the external circumference of the fixation roller 30, Step 3-*a* begins in the fixation nip N1 before Step 1-*g* ends in the fixation nip N1.

In this case, the unfixed toner on the sheet P will undergo hot-offset onto the fixation roller 30, and at the same time, the offset toner To and the contaminant toner Tc, which were on the fixation roller 30, will be fixed to the sheet P. It is rather difficult to cause the entirety of the contaminant toner Tc on the fixation roller 30, to be fixed to the sheet P during the first passage of them together through the fixation nip N1. However, the contaminant toner Tc that remained after the preceding rotation of the fixation roller 30 is eventually fixed to the sheet P during one of the following rotations of the fixation roller 30.

(Test Results)

Next, the effectiveness of the fixation unit in this embodiment, which was confirmed through a text, will be described.

The image forming apparatus used for the test was a laser printer that has a process speed of 90 mm/sec, and is capable of outputting full-color images at a rate of 14 copies per minute.

First, the structure of the fixation unit in this embodiment, which was used in the test, will be described. The ceramic heater 15 was made up of the substrate 15A, a heat generating resistor 15B, and a protective layer 15C. The substrate 15A was made of aluminum. It was 1.0 mm in thickness and 7.0 mm in width. The heat generating resistor 15B was on one of the primary surfaces of the substrate 15A. It was made of silver and palladium. It was 10 μm in thickness and 4.0 mm in width. The heat generating resistor 15B, and the surface of the substrate 15A, which was holding the heat generating resistor 15B, were covered with the protective layer 15C, which was a glass layer. It was 60 μm in thickness. The film 16 was laminated, being made of a substrate layer and a slippery layer. The substrate layer was formed of polyimide resin. It was 20 mm in inward circumference, and 30 μm in thickness. The slippery layer was formed of PFA resin, and was 20 μm in thickness.

The fixation roller 30 was made of a metallic core 30A, an elastic layer 30B, and a slippery layer 30C. The metallic core 30A was made of aluminum, and was 14 mm in external diameter. The elastic layer 30B was on the peripheral surface of the metallic core 30A, and was 3.0 mm in thickness. It was formed of silicone rubber, which was 0.2 W/m·K in thermal conductivity. The slippery layer 30C, which was the outermost layer, was on the outward surface of the elastic layer 30B. It was formed of PFE resin, and was 20 μm in thickness.

The pressure roller 17 was made up of a metallic core 17A, an elastic layer 17B, and a slippery layer 17C. The metallic core 17A was formed of aluminum and was 14 mm in external diameter. The elastic layer 17B was on the peripheral surface of the metallic core 17A, and was 3.0 mm in thickness. It was formed of silicone rubber, which was 0.2 W/m·K in thermal conductivity.

The ceramic heater 15 was kept pressed against the fixation roller 30 with the application of 100 kg of pressure, so that the fixation roller heating nip N2, which was 5.0 mm in width, was created and maintained between the film 16 and fixation roller 30. The pressure roller 17 was kept pressed upon the fixation roller 30, with the application of 15 kg of pressure, so that the fixation nip N1, which was 6.0 mm in width, was created and maintained between the pressure roller 17 and the fixation roller 30.

The image forming apparatus was provided with the pair of discharge rollers 111, which were 60 mm downstream of the fixation nip N1 in terms of the recording medium conveyance direction. After being conveyed through the fixation nip N1, the sheet P was sent to the pair of discharge rollers 111, by which it was discharged from the apparatus main assembly 101.

The image forming apparatus used in this experiment was designed as follows: When it was in the fixation mode, in which toner images were fixed to a sheet of recording medium which was 80 g/m$^2$ in basis weight, the ceramic heater 15 was controlled so that when the apparatus was used to form full-color images in an environment in which temperature was 15° C., its temperature remained in a range of 180° C.-200° C. (target range). When the fixation roller 30 and the pressure roller 17 were cold (had cooled down), the target temperature level for the ceramic heater 15 was set higher than when the fixation roller 30 and pressure roller 17 were warm. As long as the ceramic heater 15 was controlled as described above, with its target temperature level set in the above range, the toner on a sheet of recording medium was satisfactorily fixed; it was neither under-fixed, nor "hot offset".

This image forming apparatus was used in an environment which was 15° C. in temperature and 15% humidity, to print 10,000 copies of a literal image having a 5% in print ratio, using ordinary sheets for a laser printer, which was 80 g/m$^2$ in basis weight and A4 in size. By the time this printing operation was finished, contaminants had begun to adhere to the sheets of the recording medium. The observation of the interior of the fixation unit revealed that contaminants, such as the contaminant toner Tc had adhered to the film 16.

Then, the image forming apparatus was set in the cleaning mode, and a cleaning test was conducted in which an attempt was made to remove the contaminant toner Tc on the above-described film 16.

As the cleaning sheet P, a sheet of glossy paper, more specifically, a sheet of HP Presentation Paper LBP (product of Hewlett Packard Co., Ltd.), which was 130 g/m$^2$ in basis weight and of the letter size (216 mm in width and 279 mm in length) was used. The glossy paper, which is very flat, is likely to conform to the surface of the fixation roller with no gap, and therefore, makes it easier to recover the offset toner To and the contaminant toner Tc after they are made to adhere to the fixation roller 30.

In an image forming operation in which sheets of above-described glossy paper (HP Presentation Paper) were used, the image forming apparatus (fixation unit) was set for glossy paper with a basis weight of 130 g/m$^2$. Further, the ceramic heater 15 was controlled so that when the process speed is 45 mm/sec, its temperature was in a target temperature range of 180° C.-200° C. With this setup, an unfixed toner image on a sheet of the glossy paper was satisfactorily fixed; it was neither under-fixed nor "hot offset".

As the image forming apparatus was started in the cleaning mode, the process speed was set to 45 mm/sec. Then, an image forming operation was started, and also, the fixation roller 30 of the fixation unit began to be driven. The ceramic heater 15 was controlled so that its temperature remained in a range of 200° C.-220° C. Incidentally, like in the ordinary fixation mode, if the image forming apparatus begins to be operated in the cleaning mode when the fixation roller 30 and the pressure roller 17 are cold (after they have cooled down), the target temperature of the ceramic heater 15 was set relatively high, whereas if the image forming apparatus begins to be operated in the cleaning mode when the fixation roller 30 and pressure roller 17 are warm, the target temperature of the ceramic heater 15 was set relatively low. In this test, in order to cause "hot offset" by giving an excessive amount of heat to the toner on the sheet P with a basis weight of 130 g/m$^2$, the target temperature level of the ceramic heater 15 was set higher than in the ordinary fixation mode.

Then, the sheet P was conveyed, and an unfixed toner image for the cleaning mode was formed on the sheet P in the image forming portion. Then, the sheet P was conveyed into the fixation nip N1 of the fixation unit for 20 seconds after electric power began to be sent to the ceramic heater 15.

At this point of the cleaning operation, the temperature of the film 16 had climbed to 190° C.-210° C. and the temperature of the fixation roller 30 had climbed to 180° C.-200° C. Further, the temperature of the pressure roller 17 had climbed to 100° C.-120° C.

Figure 8:
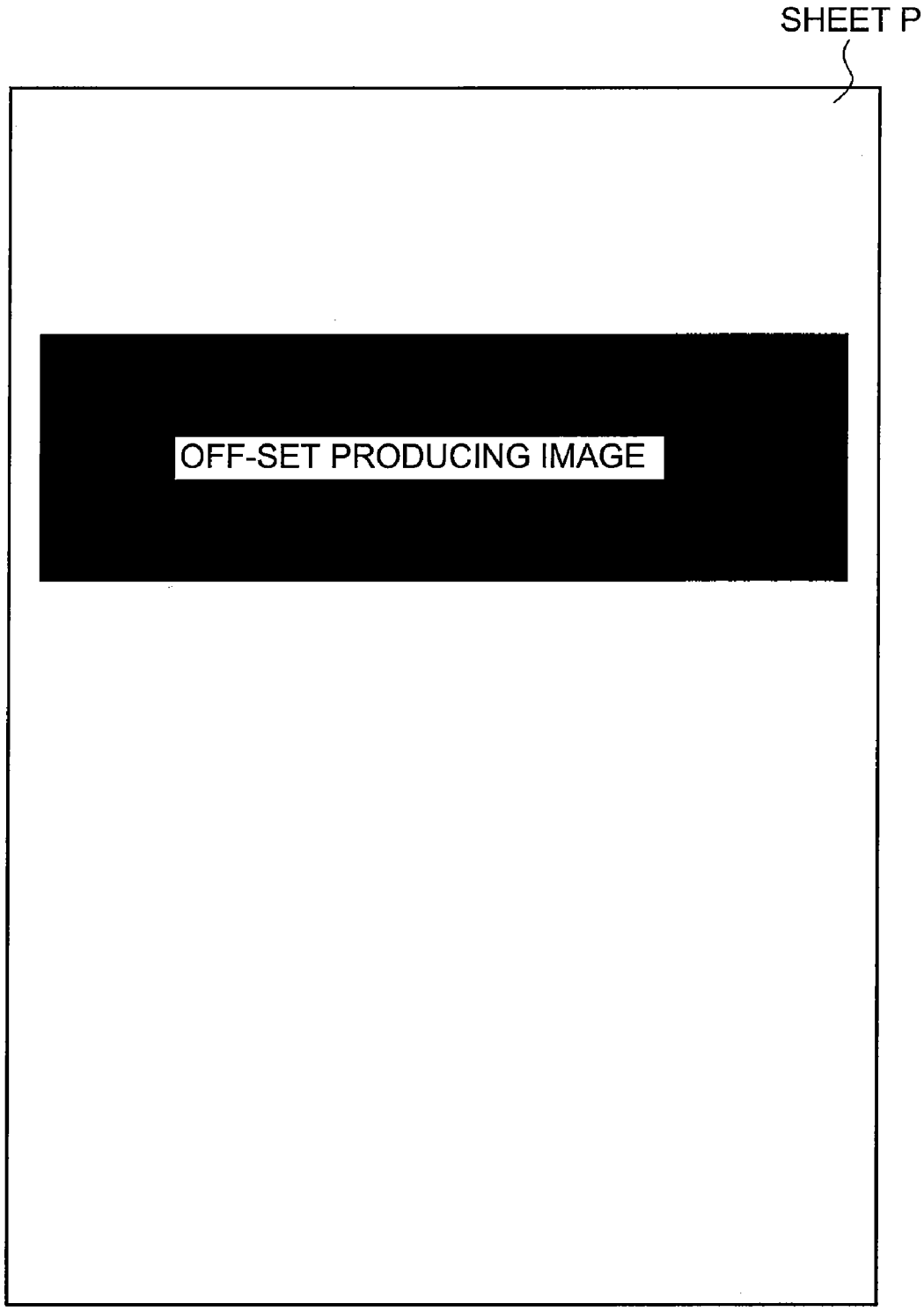
FIG. 8 is an example of the pattern of the toner image for cleaning in the first embodiment.

The pattern of the image for cleaning mode was the same as the one shown in FIG. 8. That is, the pattern was such that as it was formed on the sheet P, the portion of the sheet P, which was between the leading edge of the sheet P, in terms of the sheet conveyance direction, and a hypothetical straight line (first hypothetical line) on the sheet P, which is perpendicular to the leading edge and was 70 mm apart from the leading edge, was left as a blank (white) space; the portion of the sheet P, which was between the above-described first hypothetical straight line and a hypothetical straight line (second hypothetical line), which was perpendicular to the leading edge and was 140 mm apart from the first hypothetical line, was covered with a 200 mm wide solid black image (a 100% print ratio); and the portion of the sheet P, which was between the second hypothetical straight line and the trailing edge of the sheet P, remained as a blank (white) space. When the image for the cleaning mode, which has the above-described is formed, the amount of the toner on the solid black portion of the image is 5.0 g/m$^2$.

That is, in order to prevent the sheet P from wrapping around the fixation roller 30, the leading end portion of the sheet P, which corresponds in length to the distance between the fixation nip N1 to the nip between the pair of discharge roller 111, was left as a blank space. Then, the solid toner image, the length of which equaled the circumference of the film 16, and which was for transferring the contaminant toner Tc, and the like, on the film 16, onto the cleaning sheet P, was formed on the upstream side of the blank space. Then, the rest of the cleaning sheet P, that is, the upstream side of the solid toner image on the sheet P, was left as a blank space, onto which the contaminant toner Tc and the like would be spit out from the fixation roller 30 after being transferred onto the fixation roller 30 from the film 16. In other words, the offset toner To and the contaminant toner Tc were recovered by the cleaning sheet P, that is, a sheet of the recording media having a solid image for causing "hot offset".

Figure 12:
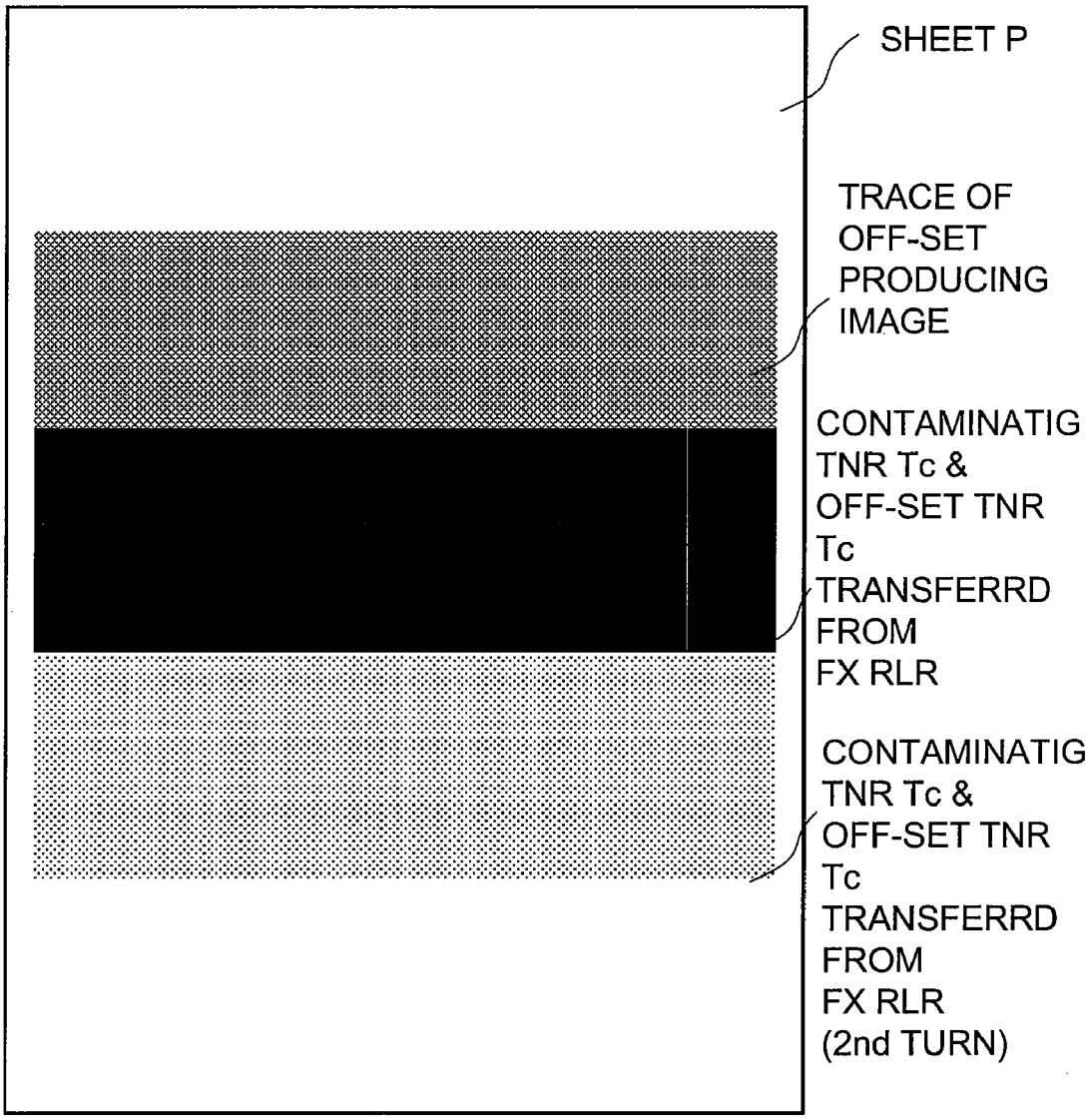
FIG. 12 is a drawing of an image on a sheet of the recording media after the completion of the cleaning of the fixation unit in the first embodiment.

Toward the end of the operation in the cleaning mode, a sheet of paper, which looked as shown in FIG. 12, was discharged from the fixation unit. The black toner in the solid image which covered the portion of the cleaning sheet P, which was between the hypothetical straight line which was perpendicular to the leading edge of the sheet P and was 70 mm apart from the leading edge of the sheet P, and the hypothetical straight line which was perpendicular to the leading edge and was 140 mm apart from the leading edge of the sheet P, had "hot offset" onto the film 16. The offset toner To was fixed, along with the contaminant toner Tc having adhered to the film 16, to the portion of the cleaning sheet P, which was between a hypothetical straight line which was perpendicular to the leading edge of the sheet P and was 133 mm apart from the leading edge of the sheet P, and a hypothetical straight line which was perpendicular to the leading edge of the sheet P and was 203 mm from the leaning edge of the sheet P, that is, the portion of the sheet P, which corresponds to the first full rotation of the fixation roller 30 after its "hot offset" rotation. The offset toner To adhered also to the portion of the cleaning sheet P, which was between the hypothetical straight line which was 203 mm from the leading edge of the cleaning sheet P, and a hypothetical straight line which was perpendicular to the leading edge of the sheet P and was 266 mm from the leading edge of the cleaning sheet P, although by only a minutes amount. However, virtually no offset toner To was visually detectable on the portion of the cleaning sheet P, which was between the hypothetical straight line which was 266 mm from the leading edge of the sheet P to the trailing edge of the sheet P, that is, the portion corresponding to the third full rotation of the fixation roller 30 after its "hot offset" rotation.

The results of this operation of the image forming apparatus, which was carried out in the cleaning mode, proved that the first embodiment of the present invention can remove the contaminants such as the contaminant toner Tc and the like which had not solidly adhered to the film 16. As for the other contaminants, that is, those that had solidly adhered to the film 16, it did not occur that they peeled from the film 16 and transferred onto the sheet P when the image forming apparatus operated in the ordinary fixation mode. In other words, this embodiment of the present invention was very effective to clean the fixation unit.

Embodiment 2

Next, the apparatus in the second embodiment of the present invention will be described. The basic structure of the image forming apparatus in this embodiment is virtually the same as that in the first embodiment, and therefore, will not be described except for the portions different from its counterparts in the first embodiment, that is, the portions that characterize this embodiment. Further, the portions, components, etc., of the image forming apparatus in this embodiment, which are the same in function as their counterparts in the first embodiment, will be given the same reference characters as those given to their counterparts in the first embodiment.

In this embodiment, the target temperature level of the fixation unit and the process speed of the image forming apparatus is switched, when the sheet P is being conveyed through the fixation unit. Further, while the toner image on the sheet P, which is for generating the offset toner To, is moving through the fixation nip N1, the amount of heat given to the fixation roller 30 is Qh, which is large enough to cause "hot offset". Then, after the passage of the "hot offset", causing the image on the sheet P through the fixation nip N1, the fixation roller 30 is heated by an amount (third amount) that is smaller than the aforementioned amount Qh, which causes "hot offset". Incidentally, the third amount in this embodiment is the same as the amount Qn, which is the amount of heat given to the fixation roller 30 in the ordinary fixation mode.

As a means for causing the offset toner To to adhere to the fixation roller 30, the toner is given the excessive amount Qh of heat to make "hot offset" occur. However, as the offset toner To is excessively melted, it becomes less likely to agglutinate, and becomes weaker in adhesiveness.

Figure 13:
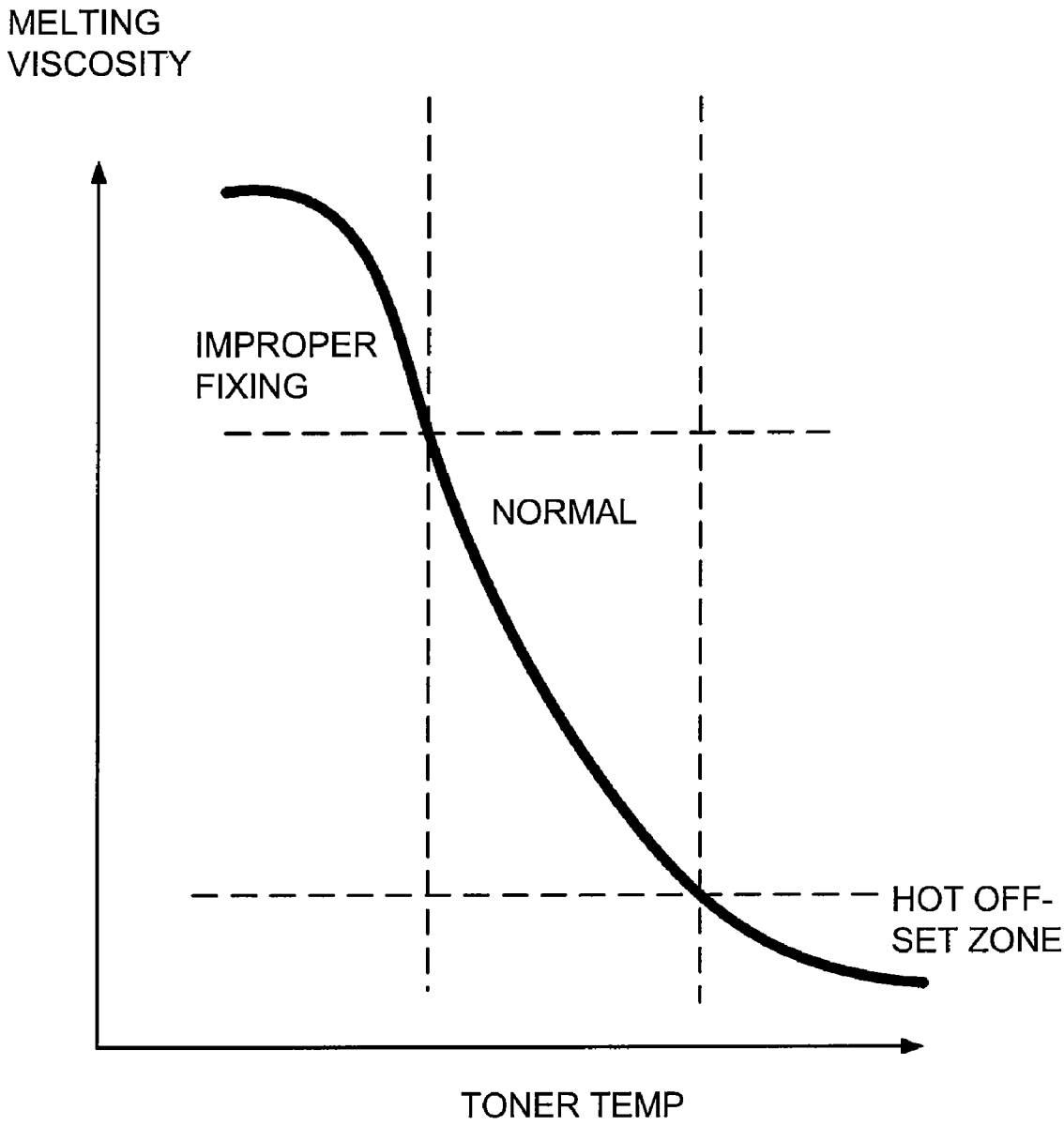
FIG. 13 is a drawing that shows the relationship between the temperature of an ordinary toner and the viscosity of the toner when the toner is in the melted state.

FIG. 13 shows the general relationship between the toner temperature and the viscosity of melted toner. As the temperature of the toner is increased by the application of an excessively amount of heat, it is likely to excessively melt, thereby excessively reducing its viscosity, agglutinability, and adhesiveness.

Reducing the amount of which heat given to the toner after the completion of Step 1, to a proper value, increases the offset toner To in agglunatability and adhesiveness; thereby improving the offset toner To in terms of its cleaning performance (i.e., its performance in cleaning the film 16) in Step 2; and makes it easier for the offset toner To to be fixed to the sheet P in Step 3. In other words, it makes it easier for the offset toner To to be recovered.

Figure 14:
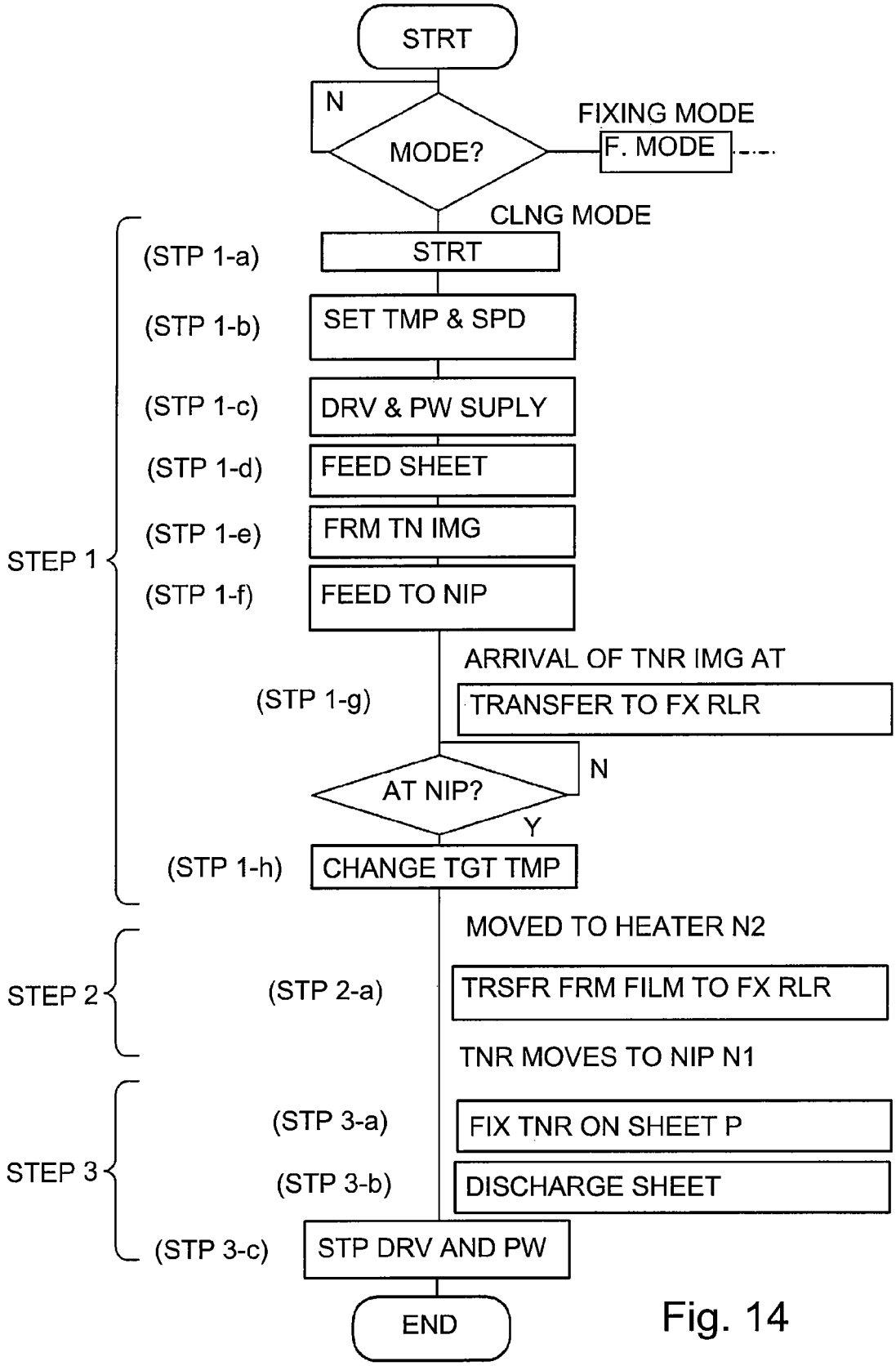
FIG. 14 is a flowchart of the operation for cleaning the fixation unit in the second embodiment of the present invention.
Figure 15:
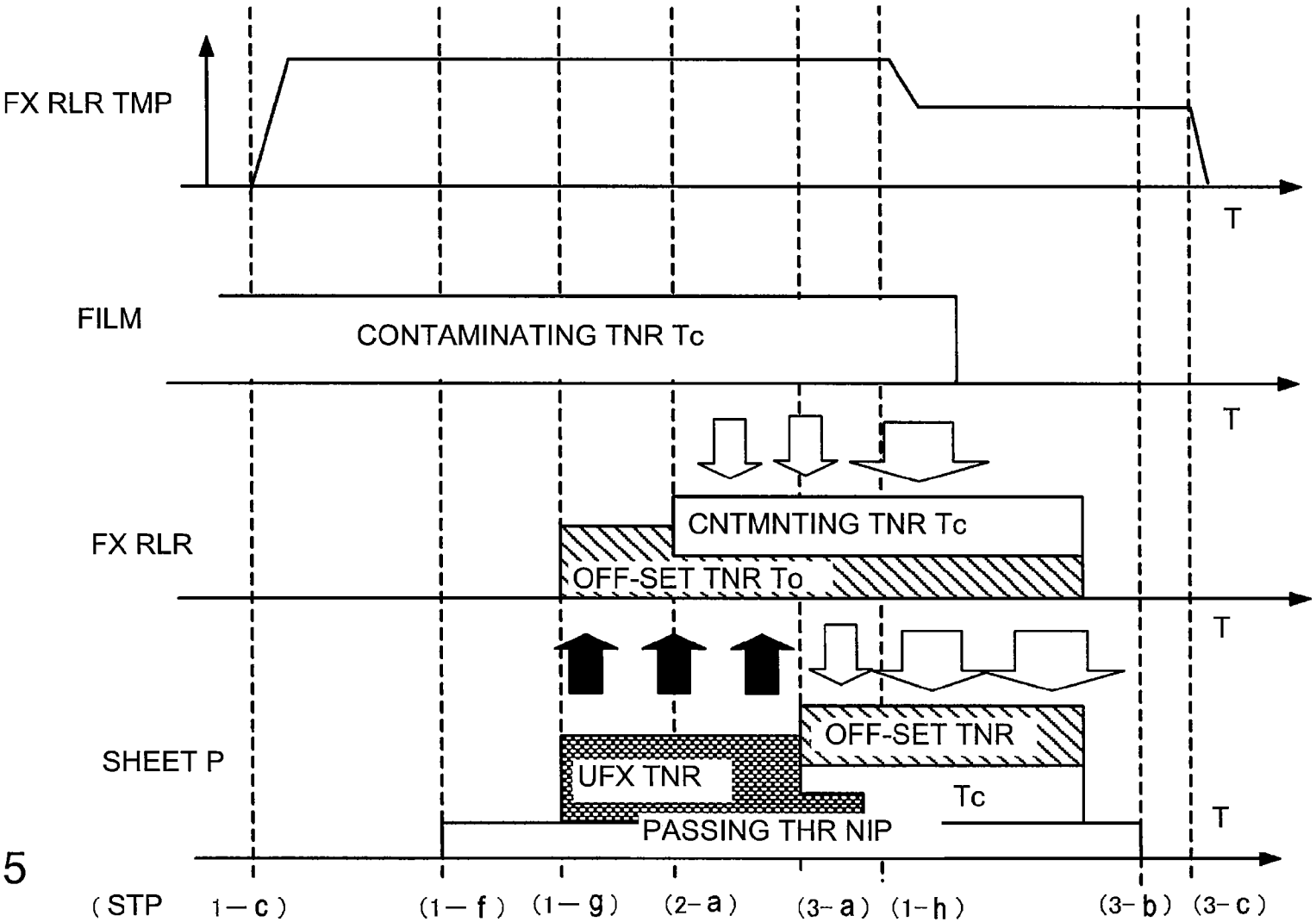
FIG. 15 is a graphical timetable, which shows the toner movements and the like in the second embodiment.

Next, referring to FIG. 14, which is a flowchart, and FIG. 15, which is a time table, the cleaning mode in this embodiment will be described. FIG. 14 is a flowchart of the operation of the image forming apparatus in this embodiment, when the apparatus is in the cleaning mode. FIG. 15 is a graphical timetable that shows the timing of the toner movement on the film 16 and the timing of the temperature changes of the fixation roller 30.

The image forming apparatus is started in the cleaning mode (Step 1-*a*). Then, a target temperature and process speed are set. The target temperature level is set to be high enough to generate the amount of heat Qh, which is large enough to cause the toner on the sheet P to "hot offset". The process speed is set to be proper to allow the toner on the sheet P to satisfactorily "hot offset" (Step 1-*b*).

Next, each of various components involved with the cleaning mode begin to be driven, and electric power begins to be sent to the heater 15, whereby the temperature of the fixation roller 30 climbs to a preset level (Step 1-*c*).

Next, the sheet P is fed into the apparatus main assembly 101 (Step 1-*d*), and an unfixed image for cleaning is formed on the sheet P (Step 1-*e*). This sheet P is conveyed to the fixation unit (Step 1-*f*). As the unfixed image on the sheet P conveyed through the fixation nip N1, the toner forming the unfixed image, turns into the offset toner To, and is transferred onto the fixation roller 30 (Step 1-*g*).

After the entirety of the image on the sheet P, which is for generating the offset toner To, passes the fixation nip N1, the target temperature of the heater 15 is changed (Step 1-*h*), whereby the fixation temperature 30 is changed in temperature, so that the sheet P will be given the amount of heat Qn, which is the same amount of heat given to the sheet P in the ordinary fixation mode.

As the fixation roller 30 rotates, the offset toner To reaches the fixation roller heating nip N2, in which it comes into contact with the film 16, whereby it transfers the contaminant toner Tc on the film 16, onto the fixation roller 30 (Step 2-*a*).

Next, as the fixation roller 30 rotates further, the contaminant toner Tc and the offset toner To reach the fixation nip N1, in which they are fixed to the sheet P (Step 3-*a*), and then, the sheet P is discharged (Step 3-*b*). Then, the electric power to the heater 15 is turned off, and the image forming apparatus is stopped, ending the image forming operation in the cleaning mode (Step 3-*c*).

In this embodiment, the timing with which Step 1-*h* is started is set so that Step 1-*h* starts after the passage of the entirety of the unfixed image on the sheet P. Therefore, the timing with which Step 1-*h* starts is after the timing with which Step 2-*a* is started, and the timing with which Step 3-*a* started, although it depends on the length of the unfixed image. Thus, the fixation unit increases in film cleaning performance during Step 2, and further, the contaminant toner Tc begins to be better fixed to the sheet P during Step 3.

That is, in this embodiment, the Step 1-*h* is not started until sometime in Step 2 and Step 3. However, even before the starting of Step 1-*h*, Step 2 and Step 3 work just as well as after the starting of Step 1-*h*, as they do in the first embodiment.

The timing with which Step 1-*h* is to be started may be set so that Step 1-*h* is started as the distance between the leading edge of the unfixed image on the sheet P and the fixation nip N1 becomes equal to the external circumference of the film 16 after the passage of the leading edge of the unfixed image through the fixation nip N1. The amount of offset toner To adhered to the fixation roller 30 is proportional to the external circumference of the film 16. The rest of the toner forming the unfixed image is ordinarily fixed to the sheet P.

The length of time the offset toner To is adhered to the fixation roller 30 in Step 1 becomes shorter, that is, it becomes equal to the length of time it takes for the film 16 to fully rotate once in the ordinary image-fixing operation. However, the period in which the fixation unit is higher in cleaning performance in Step 2, and the period in which it is easier for the offset toner To and contaminant toner Tc to be fixed in Step 3, are longer. Therefore, if the sheet P is unsatisfactory in terms of flatness and smoothness, and therefore, it is feared that the offset toner To and the contaminant toner Tc on the fixation roller 30 may not be fully recovered, Step 1-*h* had better be started with the above-described timing.

(Test Results)

A test is carried out to confirm the effectiveness of the fixation unit in this embodiment in the cleaning mode. The image forming apparatus and the fixation unit used for the experiment are the same as those in the first embodiment.

The fixation unit in this embodiment was tested in terms of the effectiveness with which it can remove the contaminant toner To having adhered to the film 16, in the same manner as the fixation unit in the first embodiment was tested.

The cleaning sheet P used to test the fixation unit in this embodiment was a sheet of ordinary LBP printing paper (CLC 80 g: product of Canon), which was 82 g/m$^2$ in basis weight, and A4 (210 mm in width and 297 mm in length). In terms of flatness, recording medium CLC 80 g, which is ordinary paper for color printing, is relatively high, although it is inferior to glossy paper. The image forming apparatus (fixation unit) in this embodiment can more easily recover the offset toner To on the fixation roller 30 than the image forming apparatus (fixation unit) in the preceding embodiment. Therefore, it is unnecessary to use glossy paper, which usually is more expensive than ordinary paper; the fixation unit can be cleaned with the use of ordinary flat paper.

When this paper (CLC 80 g) was used as recording medium in an ordinary image forming operation, the apparatus was operated in the fixation mode for ordinary paper, which is 80 g/m$^2$. The process speed was set to 70 mm/sec, and the ceramic heater 15 was controlled so that its temperature was in a range of 180° C.-200° C., in order to ensure that an ordinary image was satisfactorily fixed, that is, to prevent the problem that the image is under-fixed and/or "hot offset".

As the image forming apparatus was started in the cleaning mode, the process speed was set to 45 mm/sec, which was half the process speed in the ordinary fixation mode. Then, an image forming operation was started, and also, the fixation roller 30 of the fixation unit began to be driven. The ceramic heater 15 was controlled so that its temperature remained in a range of 200° C.-220° C.

Then, the sheet P was conveyed, and an unfixed toner image for the cleaning mode was formed on the sheet P in the image formation portion. Then, the sheet P was conveyed to the fixation nip N1 of the fixation unit with such a timing that it entered the fixation nip N1 20 seconds after electric power began to be sent to the ceramic heater 15.

At this point of the cleaning operation, the temperature of the film 16 had climbed to 190° C.-210° C., and the temperature of the fixation roller 30 had climbed to 180° C.-200° C. Further, the temperature of the pressure roller 17 had climbed to 100° C.-120° C. The pattern of the image for cleaning mode was the same as the one in the first embodiment.

As the portion of the sheet P, which was between the leading edge of the sheet P and a hypothetical line on the sheet P, which was 140 mm from the leading edge, passed through the fixation nip N1, the target temperature range for the ceramic neater 15 was changed to 160° C.-180° C. while the process speed was kept at 45 mm/sec. This setup was for giving a proper amount of heat to the toner on the sheet P so that neither the under-fixation nor hot "offset" would occur when the process speed was 45 mm/sec.

Also at this point of the cleaning operation, the temperature of the film 16 was in a range of 150° C.-170° C., and the temperature of the fixation roller 30 was in a range of 140° C.-160° C. Further, the temperature of the pressure roller 17 was in a range of 70° C.-90° C.

The results of this test in which the image forming apparatus was operated in the cleaning mode were as follows: Among the contaminants such as the contaminant toner Tc having adhered to the film 16, those which had not solidly adhered to the film 16 were removed. Further, the problem that the rest of the contaminants peel away from the film 16 and appear on the sheet P while the apparatus is operated in the ordinary fixation mode did not occur. In other words, this embodiment of the present invention also was very effective to clean the fixation unit.

In this embodiment, the offset toner To and the contaminant toner Tc, which were adhered to the peripheral surface of the fixation roller 30, were entirely recovered by being adhered to the surface of the sheet P, in spite of the use of a sheet of paper, which was ordinary in terms of flatness, as the cleaning sheet P.

Embodiment 3

Next, the image forming apparatus (fixation unit) in the third embodiment of the present invention will be described. The basic structure of the apparatus in this embodiment is the same as those of the apparatuses in the preceding embodiments. Therefore, the portions of the structure of the apparatus in this embodiment, which are the same in function as those in the preceding embodiments will not be described. Further, the components, portions, etc., which are the same in function as the counterparts in the preceding embodiments will be given the same reference characters as those given to their counterparts in the preceding embodiments.

In this embodiment, the cleaning sheet P is formed so that the image from which toner is "hot offset" is on the leading end portion of the sheet P, and the image for recovering the offset toner To, that is, the portion of the sheet P onto which the toner on the fixation roller 30 is transferred, is on the trailing end portion of the sheet P.

Figure 16:
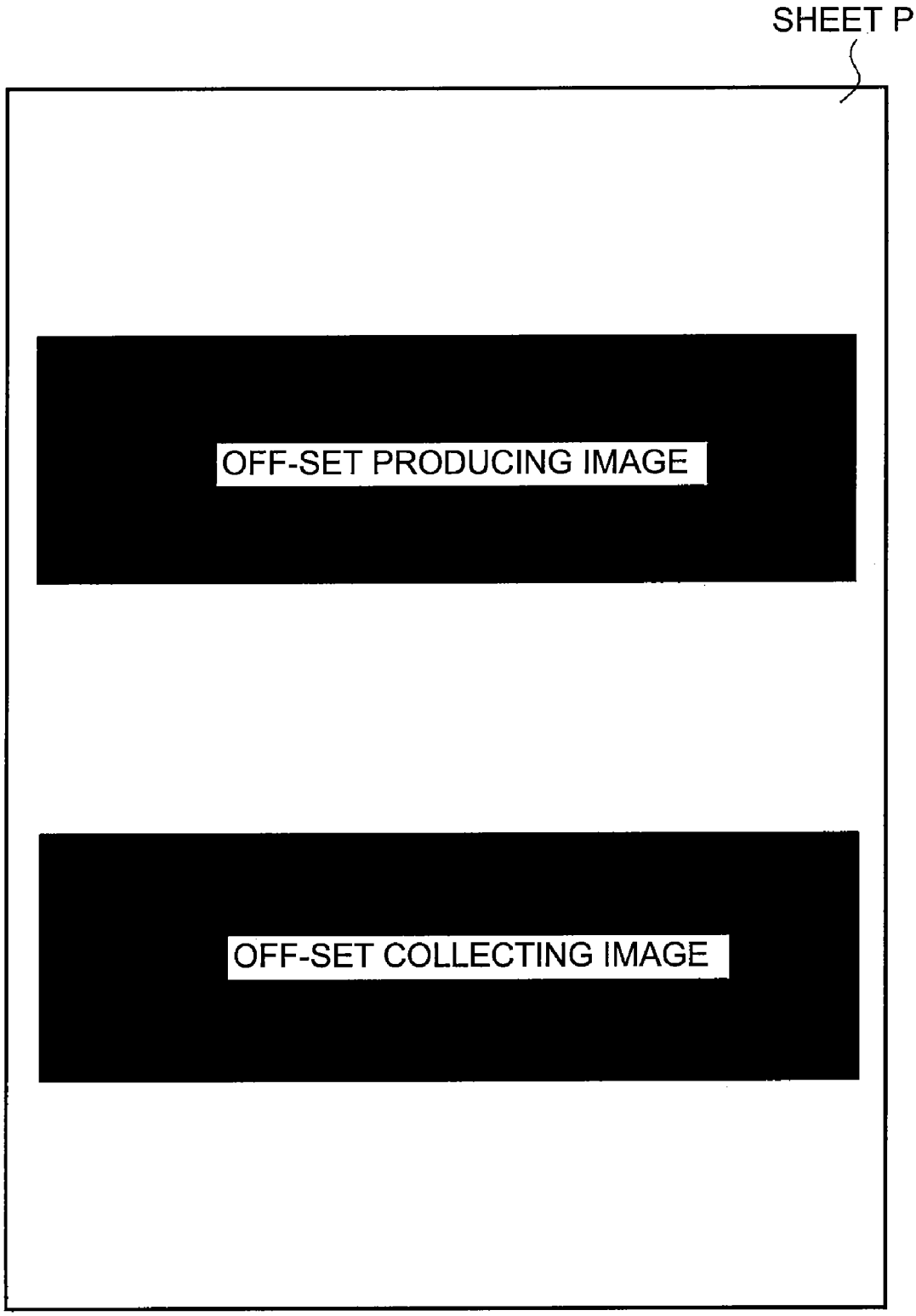
FIG. 16 is a drawing of the pattern of the image for cleaning the fixation unit in the third embodiment of the present invention.

FIG. 16 is a drawing of an example of the pattern in which an image for the cleaning mode is formed. That is, the portion of the sheet P, which is between the leading edge of the sheet P and a hypothetical straight line (first hypothetical line) which is perpendicular to the leading edge of the sheet P, and the distance of which from the leading edge is no less than the distance between the fixation nip N1 and the pair of discharge rollers 111, is left as a blank; toner is not transferred onto this portion of the sheet P. The portion of the sheet P, which is on the upstream side of the first hypothetical straight line is covered with a solid image which is no less in length (in terms of lengthwise direction of sheet P) than the circumference of the film 16, and is 50%-300%, preferably 70%-200%, in print ratio. This solid image is used as the source of the offset toner To. On the portion of the sheet P, which is between this solid image and the trailing edge of the sheet P, a solid image which is longer than the circumference of the film 16, and is no less than 50% preferably, 100%, in print ratio, is formed. This image is used as the image for recovering the offset toner To.

In this embodiment, the target temperature and the process speed of the fixation roller of the image forming apparatus are changed while the sheet P is being moved through the fixation unit. More concretely, while the image on the sheet P, which is the source of the offset toner To, is being moved through the fixation nip N1, the amount of heat given is Qh, which is large enough to cause "hot offset". Then, after the passage of the image on the sheet P, which is the source of the offset toner To, through the fixation nip N1, the amount of heat given is Qn, which is the same as the amount of heat given in the ordinary fixation mode, that is, the fixation mode which does not cause "hot offset".

While the toner image on the sheet P, which is for the recovery of the offset toner To, is being moved through the fixation nip N1, the amount of heat given is Qn, which is the same as the amount of heat given in the ordinary fixation mode, that is, the fixation mode in which "hot offset" does not occur. At the same time as the image for recovering the offset toner To is fixed to the sheet P, it peels the offset toner To and the contaminant toner Tc having adhered to the fixation roller 30, from the fixation roller 30, by its adhesiveness, making it easier for the offset toner To and the contaminant toner Tc to be recovered by the cleaning sheet P. The higher the print ratio of the image for the contaminant recovery, the more adhesive it becomes, and therefore, the easier it makes for the offset toner To and the contaminant toner Tc to be recovered by the cleaning sheet P.

Figure 17:
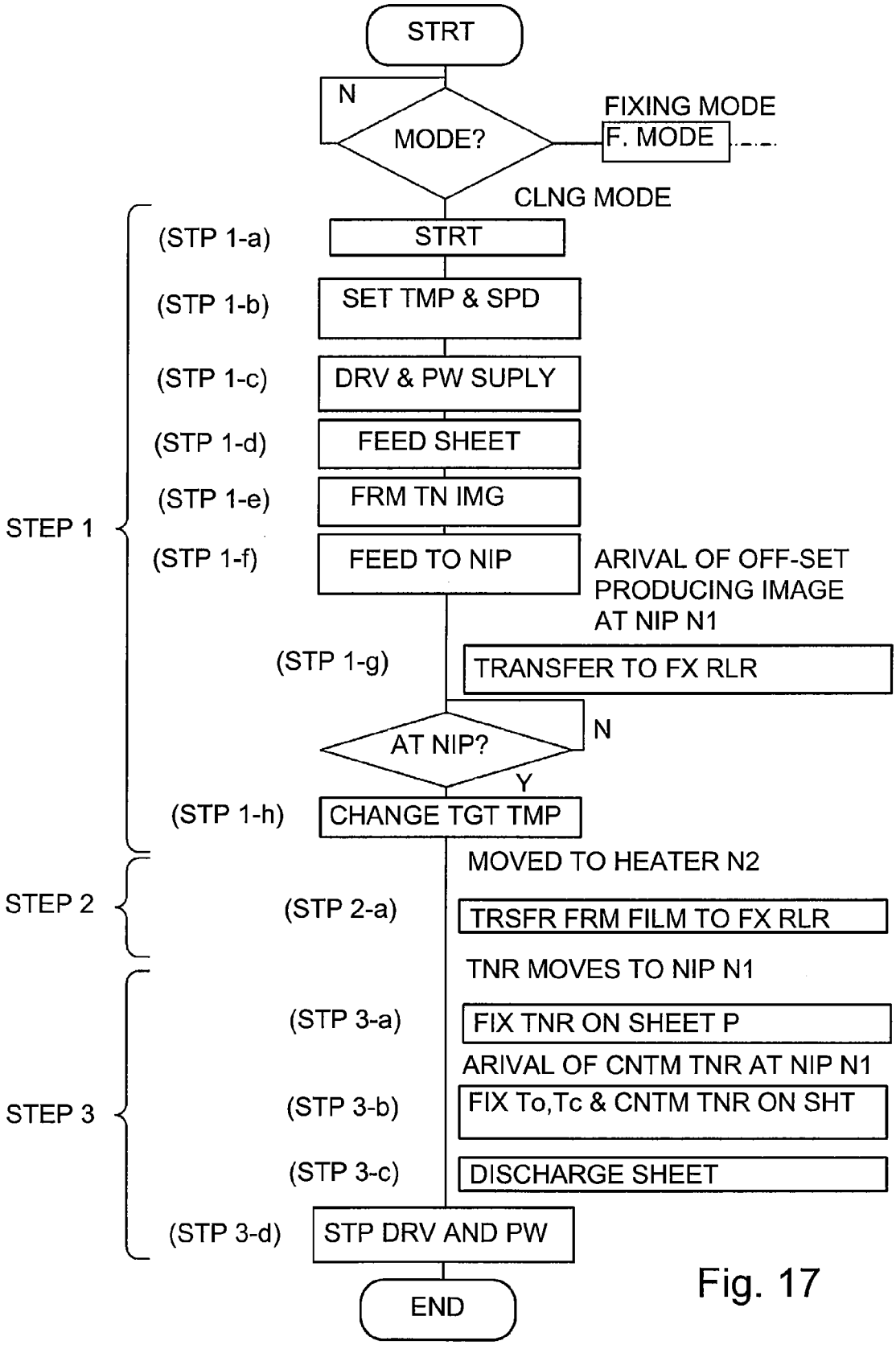
FIG. 17 is a flowchart of the operation for cleaning the fixation unit in the third embodiment.
Figure 18:
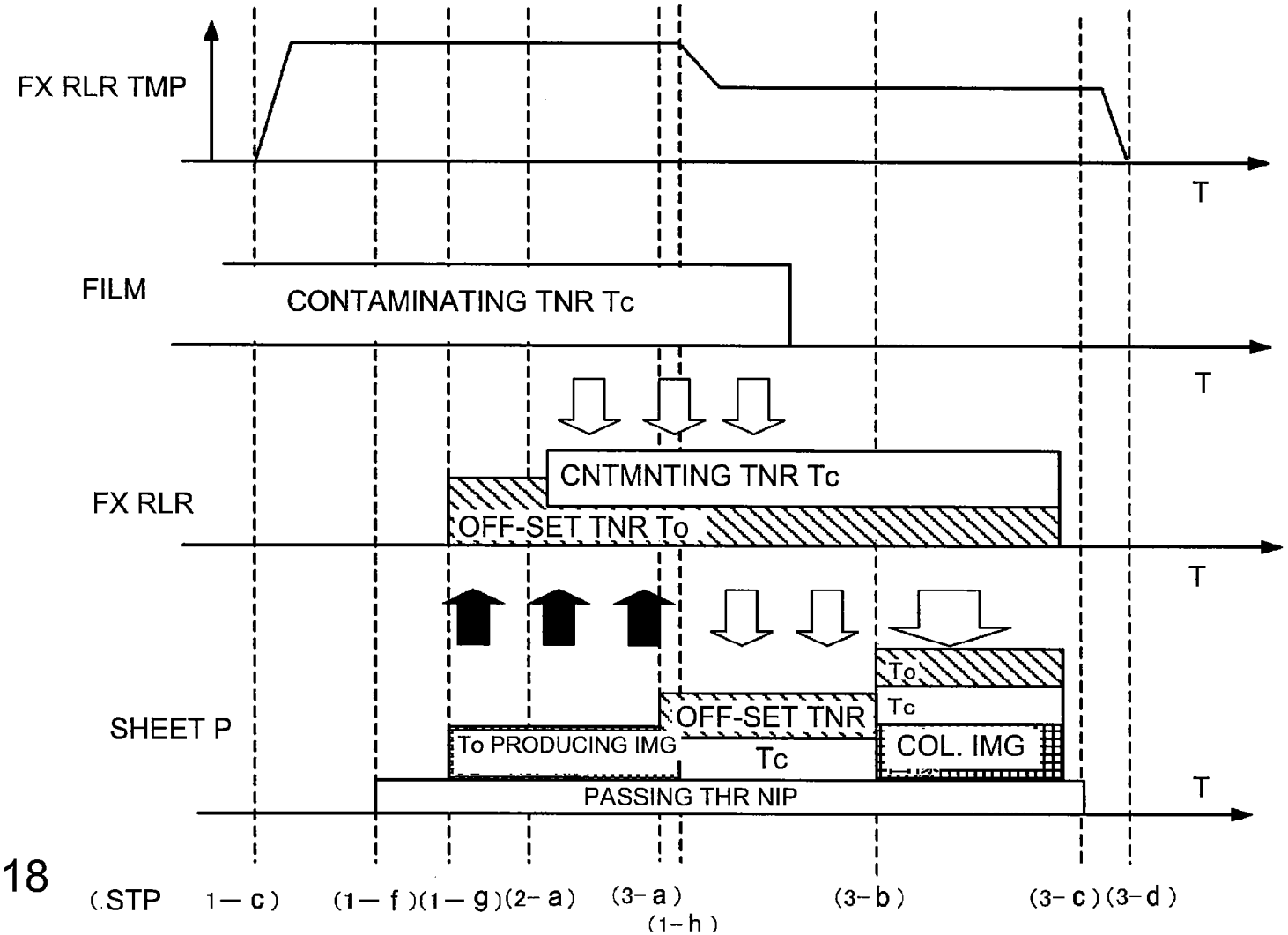
FIG. 18 is a graphic timetable that shows the toner movements and the like in the third embodiment.

At this time, referring to FIG. 17 (flowchart) and FIG. 18 (time table), the process carried out when the image forming apparatus (fixation unit) is in the cleaning mode will be described. FIG. 17 is a flowchart of the operation of the image forming apparatus in this embodiment when the apparatus is in its cleaning mode. FIG. 18 is a graphical timetable that shows the timing of the toner movement on the film 16 and the timing of the temperature changes of the fixation roller 30.

The image forming apparatus is started in the cleaning mode (Step 1-*a*). Then, a target temperature and process speed are set. The target temperature level is to be high enough to generate the amount of heat Qh, which is large enough to cause the toner on the sheet P to "hot offset". The process speed is to be proper to allow the toner on the sheet P to satisfactorily "hot offset" (Step 1-*b*).

Next, each of various components involved with the cleaning mode begin to be driven, and electric power begins to be sent to the heater 15, whereby the temperature of the fixation roller 30 climbs to a preset level (Step 1-*c*). Next, the sheet P is fed into the apparatus main assembly 101 (Step 1-*d*). Then, an unfixed image for generating the offset toner To, and an unfixed image for recovering the offset toner To and the contaminant toner Tc, are formed on the sheet P (Step 1-*e*).

This sheet P is conveyed to the fixation unit, and the unfixed image on the sheet P, which is for the generation of the offset toner To, reaches the fixation nip N1. As the unfixed image on the sheet P, which is for generating the offset toner To, reaches the fixation nip N1 (Step 1-*f*), the toner, of which the unfixed image is formed, turns into the offset toner To, and transfers ("hot offset") onto the fixation roller 30 (Step 1-*g*).

After the image on the sheet P, which is for generating the offset toner To, passes the fixation nip N1, the target temperature of the heater 15 is changed, thereby changing the temperature of the fixation roller 30, so that the sheet P will be given the amount of heat Qn, which is the same amount of heat given to the sheet P in the ordinary fixation mode (Step 1-*h*).

As the fixation roller 30 rotates, the offset toner To on the fixation roller 30 reaches the fixation roller heating nip N2, in which it comes into contact with the film 16, whereby it transfers the contaminant toner Tc on the film 16, onto the fixation roller 30 (Step 2-*a*).

Next, as the fixation roller 30 rotates further, the contaminant toner Tc and the offset toner To on the fixation roller 30 reach the fixation nip N1, in which they are fixed to the sheet P (Step 3-*a*). Thereafter, the image on the sheet P, which is for recovering the offset toner To, reaches the fixation nip N1, in which the contaminant toner Tc and the offset toner To are fixed, along with the toner image for recovery, to the sheet P (Step 3-*b*). Then, the sheet P is discharged (Step 3-*c*). Then, the electric power to the heater 15 is turned off, and the image forming apparatus is stopped, ending the image forming operation in the cleaning mode (Step 3-*d*).

(Test Results)

A test was carried out to confirm the effectiveness of the fixation unit in this embodiment in the cleaning mode. The image forming apparatus and the fixation unit used for the test were the same as those in the first embodiment. The fixation unit in this embodiment was tested in terms of the effectiveness with which it can remove the contaminant toner To having adhered to the film 16, in the same manner as the manner in which the fixation unit in the first embodiment was tested.

As the image forming apparatus was started in the cleaning mode, the process speed was set to 40 mm/sec, which was half the process speed in the ordinary fixation mode. Then, an image forming operation was started, and the driving of the fixation roller 30 of the fixation unit was also started. The ceramic heater 15 was controlled so that its temperature remained in a range of 200° C.-220° C.

The cleaning sheet P used to test the fixation unit in this embodiment was a sheet of ordinary LBP printing paper (product of), which was 80 g/m$^2$ in basis weight, and A4 in size. The sheet of paper used as the cleaning sheet in this test was not a sheet of paper dedicated to color printing. It was a sheet of ordinary LBP printing paper. It was not special in terms of flatness. However, when the image forming apparatus (fixation unit) in this embodiment was operated in the fixation mode, an image for recovering the offset toner To and the contaminant toner Tc was formed on the trailing end portion of the cleaning sheet P. Therefore, the fixation unit (film 16) was satisfactorily cleaned.

In the test, the sheet P was conveyed to the image forming portion, and an unfixed toner image for the cleaning mode was formed on the sheet P in the image formation portion. Then, the sheet P was conveyed to the fixation nip N1 of the fixation unit with such a timing that it entered the fixation nip N1 20 seconds after electric power began to be sent to the ceramic heater 15.

At this point of the cleaning operation, the temperature of the film 16 had climbed to 190° C.-210° C., and the temperature of the fixation roller 30 had climbed to 180° C.-200° C. Further, the temperature of the pressure roller 17 had climbed to 100° C.-120° C.

As for the pattern of the image formed on the sheet P for the cleaning mode, the portion of the sheet P, which was between the leading edge of the sheet P to a hypothetical straight line (first line) on the sheet P, which was 70 mm apart from the leading edge, was left as a blank (white) space; the portion of the sheet P, which was between the aforementioned first hypothetical straight line on the sheet P to a hypothetical straight line (second line) which was 140 mm from the leading edge of the sheet P, was covered with a monochromatic solid image, which was formed of black toner and was 200 mm in width; the portion of the sheet P, which was between the hypothetical second straight line which was 140 mm apart from the leading edge of the sheet P, and a hypothetical straight line (third line) which was 210 mm apart from the leading edge of the sheet P, was left as a blank (white) space; and the portion of the sheet P, which was between the hypothetical third straight line which was 210 mm apart from the leading edge of the sheet P and the trailing edge of the sheet P, was covered with a solid image, which was formed of cyan toner and magenta toner, was 200% in print ratio, and was 210 mm in width.

The image formed on the portion of the sheet P, which was between the first hypothetical line which was 70 mm apart from the leading edge and the second hypothetical line which was 140 mm apart from the leading edge, was for generating the offset toner To, and the image formed on the portion of the sheet P, which was between the aforementioned two hypothetical straight lines which were 140 mm and 210, respectively, apart from the leading edge of the sheet P, was for recovering the offset toner To.

The portion of the sheet P, which was between the leading edge of the sheet P and the first hypothetical straight line which was 70 mm apart from the leading edge, was left as a blank (white) space in consideration of the length of time it takes for the fixation unit to change the fixation temperature. This portion of the sheet P also functioned to recover the offset toner To having adhered to the fixation roller 30.

As the portion of the sheet P, which was between the leading edge of the sheet P and the second hypothetical line on the sheet P, which was 140 mm apart from the leading edge, and which passed through the fixation nip N1, the target temperature range for the ceramic heater 15 was changed to 160° C.-180° C. while the process speed was kept at 45 mm/sec. This temperature setup was for giving a proper amount of heat to the toner on the sheet P so that neither under-fixation nor "hot offset" would occur when the process speed was 45 mm/sec.

When the fixation roller 30 and the pressure roller 17 were cold (had cooled down), the target temperature for the ceramic heater 15 was set higher than when the fixation roller 30 and the pressure roller 17 were warm. By the time the portion of the sheet P, which was 210 mm apart from the leading edge of the sheet P, reached the fixation nip N1, the temperature of the ceramic heater 15 and the temperature of the fixation roller 30, changed to the target temperature level for the ordinary fixation mode. Thus, the image for recovering the offset toner To was fixed, without being "hot offset" at all.

At this point in time, the temperature of the film 16 was 150° C.-170° C., and the temperature of the fixation roller 30 was 140° C.-160° C. Further, the temperature of the pressure roller 17 was 70° C.-90° C.

The results of this operation in the cleaning mode were as follows: Among the contaminants such as the contaminant toner Tc having had adhered to the film 16, those which had not solidly adhered to the film 16 were removed. Further, it did not occur that the rest of the contaminants peeled from the film 16 and transferred onto the sheet P when the image forming apparatus was in the normal fixation mode. In other words, this embodiment of the present invention also was excellent in terms of effectiveness in the fixation mode.

Although the sheet of paper used as the cleaning sheet P in this embodiment was no flatter than a sheet of ordinary paper, the offset toner To and the contaminant toner Tc, which were adhered to the peripheral surface of the fixation roller 30, were entirely recovered by being fixed to the surface of the sheet P.

Embodiment 4

Next, the image forming apparatus in the fourth embodiment of the present invention will be described. The basic structure of the apparatus in this embodiment is the same as those of the apparatuses in the preceding embodiments. Therefore, the portions of the structure of the apparatus in this embodiment, which are the same in function as those in the preceding embodiments will not be described. Further, the components, portions, etc., which are the same in function as their counterparts in the preceding embodiments will be given the same reference characters as those given to their counterparts in the preceding embodiments.

In this embodiment, the cleaning operation is carried out using sheets P1 and P2. The sheet P1 is for generating the offset toner To. The sheet P2 is for recovering the offset toner To.

The image for generating the offset toner To is formed on the sheet P1 for generating the offset toner To, which is the first sheet of paper to be fed into the image forming apparatus when the apparatus is in the fixation mode. The sheet P1 is conveyed to the fixation nip N1. In the fixation nip N1, the toner of which the image on the sheet P1 is formed is adhered to the fixation roller 30 by giving the amount of heat Qh to the sheet P1 and the image thereon, which is large enough to cause "hot offset". Then, the target temperature and process speed of the apparatus are changed.

Then, an image for recovering the offset toner To is formed on the sheet P2, that is, the sheet for recovering the offset toner To. Then, the sheet P2 is conveyed to the fixation nip N1. In the fixation nip N1, the offset toner To and the contaminant toner Tc, having been adhered to the fixation roller 30, are recovered by giving the amount of heat Qn to the toner on the sheet P2, which does not cause under-fixation or "hot offset", that is, the same amount as the amount of heat given to the toner on a sheet of the recording media when the apparatus is in the ordinary fixation mode.

It is desired that the fixation roller 30, the film 16, and the pressure roller 17 fully rotate several times between when the sheet P1 comes out of the fixation nip N1 and when the sheet P2 is introduced into the fixation nip N1.

Regarding the relationship between the adhesiveness between the surface layer (slippery layer) of the pressure roller 17 (backup member) and the toner, and the adhesiveness between the surface layer (slippery layer) of the surface layer 30C (slippery layer) of the fixation roller 30 and the toner, the former is higher than the latter; the surface layer of the pressure roller 17 is slipperier than the surface layer 30C (slippery layer) of the fixation roller 30.

The method used for testing the apparatus in this embodiment was the same as that used for testing the apparatus in the first embodiment. However, it is desired that when the apparatus in this embodiment is in the cleaning mode, the length of time between when electric power begins to be sent to the ceramic heater 15 and when the sheet P1 begins to be conveyed through the fixation nip N1 is made as long as possible, in order for the fixation unit to become warm enough to make the difference in temperature between the fixation roller 30 and pressure roller 17 relatively small.

This is desired to prevent the toner on the fixation roller 30 from transferring onto the pressure roller 17 during the period between when the sheet P1 comes out of the fixation nip N1 and when the sheet P2 begins to be conveyed through the fixation nip N1.

Figure 19:
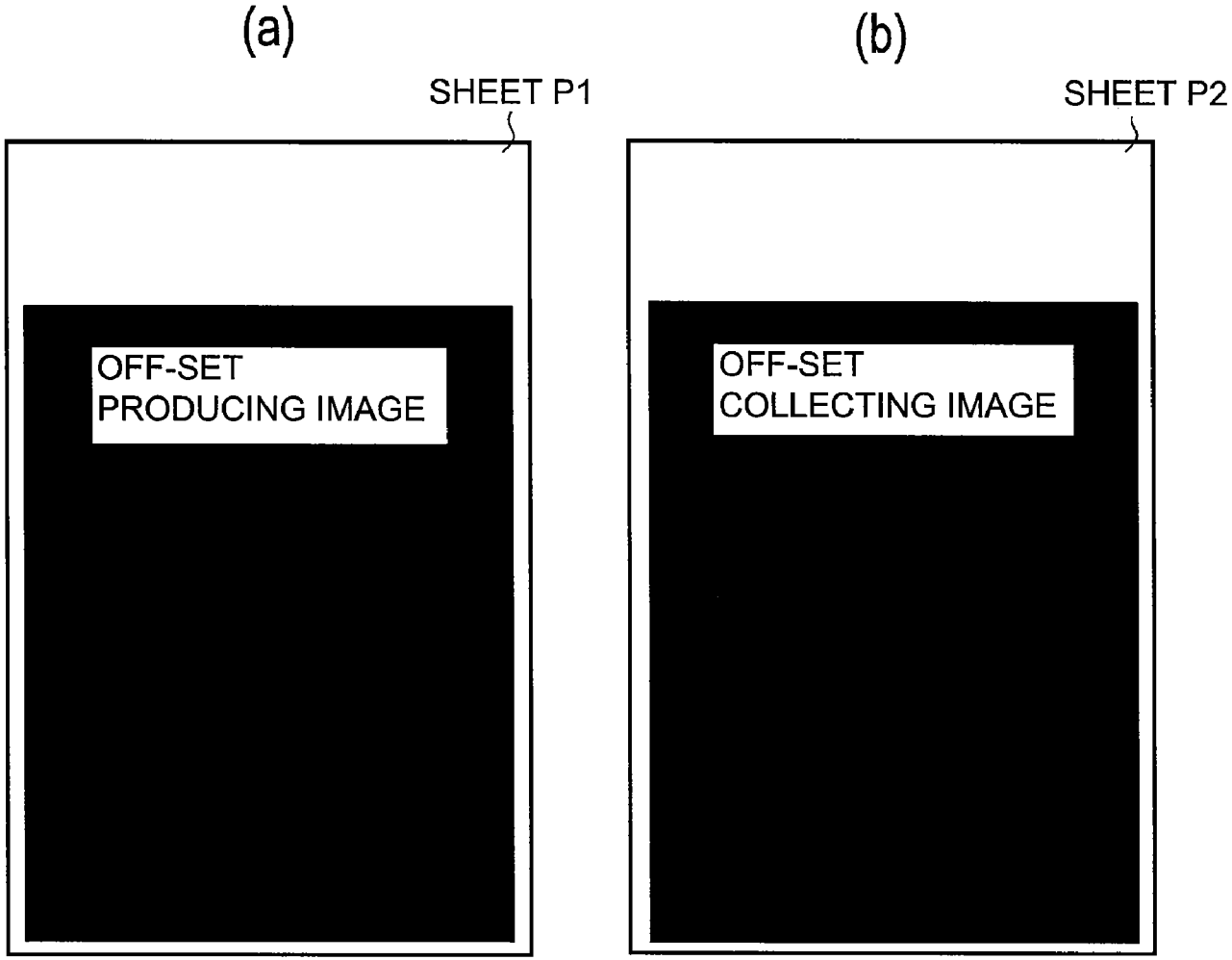
FIG. 19 is a drawing of the pattern of the image for cleaning the fixation unit in the fourth embodiment of the present invention.

Next, referring to FIGS. 19(*a*) and 19(*b*), the image for the cleaning mode in this embodiment will be described.

The pattern in which the image for the cleaning mode is formed on the sheet P1 (sheet for generating the offset toner To) is as follows: As the pattern is printed on the sheet P1, the portion of the sheet P1, which is between the leading edge of the sheet P1 and a hypothetical straight line which is perpendicular to the leading edge, and the distance of which from the leading edge is no less than the distance from the fixation nip N1 to the pair of discharge rollers 111, is left as a blank (white) space (no toner is placed on this area); and the portion of the sheet P1, which is between the abovementioned hypothetical straight line and the trailing edge of the sheet P1 or another hypothetical straight line which is perpendicular to the leading edge, and the distance of which from the first hypothetical straight line is no less than the circumference of the film 16, is covered with a solid image, the print ratio of which is in a range of 50% -300%, preferably, 70%-200%. The sheet P1 across which the image is formed in the above-described pattern, is used as the sheet P for generating the offset toner To.

The offset toner To which came onto the fixation roller 30 from the trailing edge portion of the sheet P1 remains on the fixation roller 30, and keeps on cleaning the film 16, until the second sheet P2 is introduced into the fixation nip N1.

The image pattern for the sheet P2 (sheet for recovering the offset toner To) is as follows: As the pattern is printed on the sheet P2, the portion of the sheet P2, which is between the leading edge of the sheet P2 and a hypothetical straight line on the sheet P2, which is perpendicular to the leading edge, and the distance of which from the leading edge is no less than the distance from the fixation nip N1 to the pair of discharge rollers 111, is left as a blank (white) space (no toner is placed on this area); and the portion of the sheet P2, which is between the abovementioned hypothetical straight line and the trailing edge of the sheet P2 or another hypothetical straight line on the sheet P2, which is perpendicular to the leading edge, and the distance of which from the first hypothetical straight line is no less than the circumference of the film 16, is covered with a solid image, the print ratio of which is no less than 50%, preferably, 100%. The sheet P across which the image is formed of toner in the above-described pattern, is used as the sheet P2, that is, the sheet P for recovering the offset toner To.

When the apparatus in this embodiment is in the cleaning mode, the offset toner To on the fixation roller 30 can be moved through the fixation roller heating nip N2 two or more times. Thus, it is more effective in terms of the cleaning of the film 16 than those in the preceding embodiments. Further, the contaminant toner Tc on the pressure roller 17 also can be recovered by placing the offset toner To on the fixation roller 30, in contact with the pressure roller 17, in the fixation nip N1.

Figure 20:
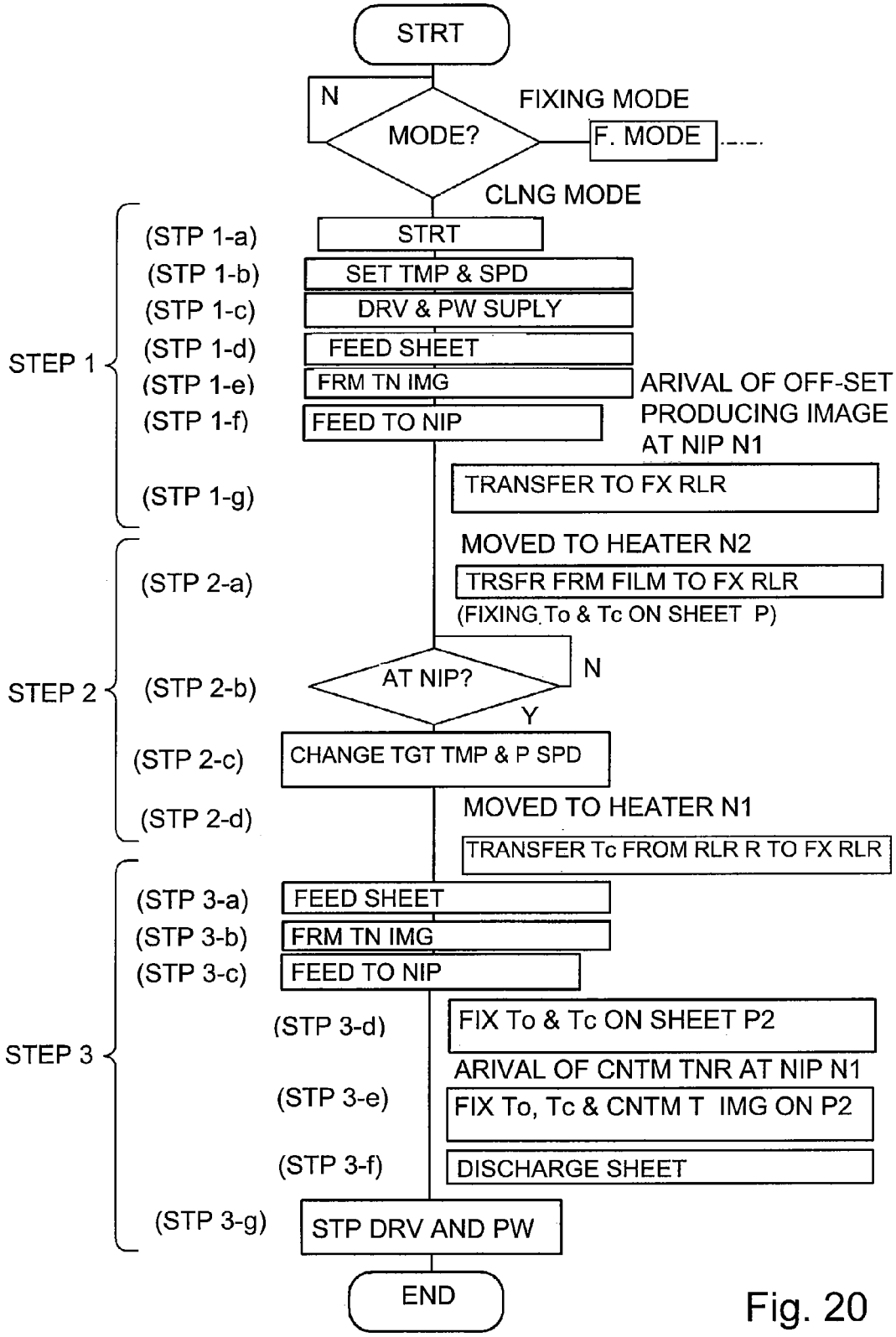
FIG. 20 is a flowchart of the operation for cleaning the fixation unit in the fourth embodiment.
Figure 21:
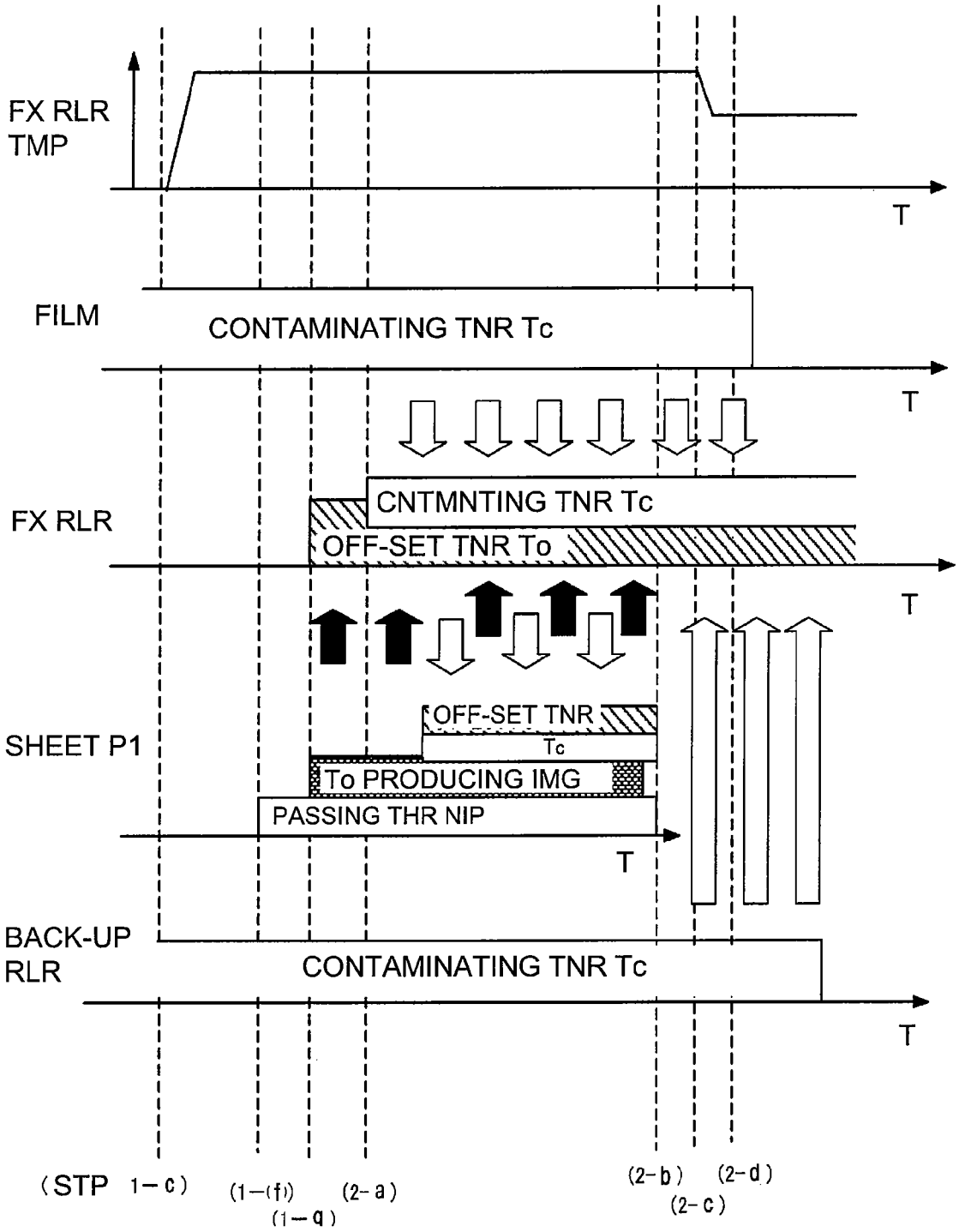
FIG. 21 is a graphic timetable which shows the toner movements and the like which occur while a sheet of the recording media is conveyed through the fixation unit in the fourth embodiment.
Figure 22:
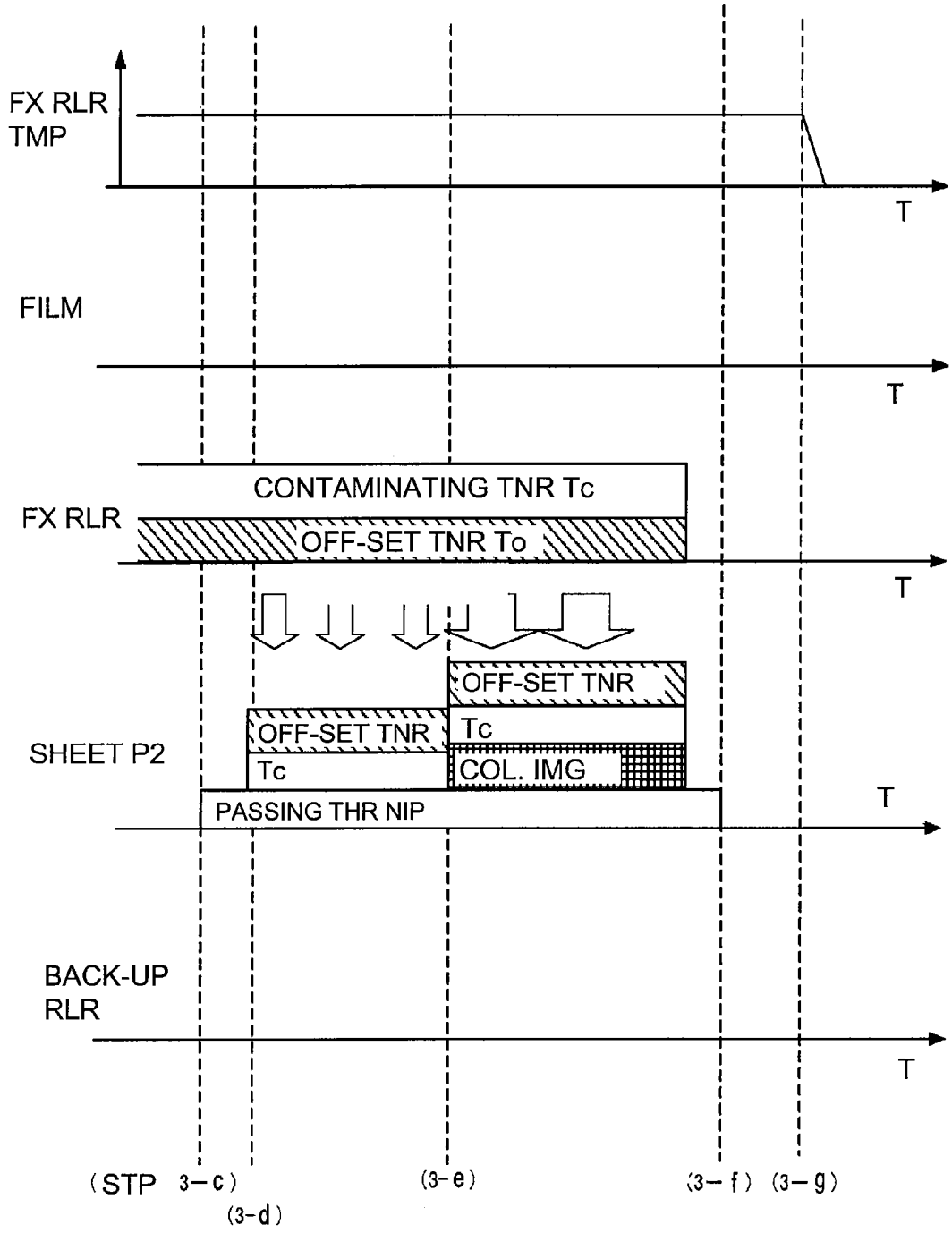
FIG. 22 is a graphic time table which shows the toner movements and the like, which occur while a sheet of the recording media is conveyed through the fixation unit in the fourth embodiment.

Next, referring to FIGS. 20 (flowchart), 21 (time table), and 22 (time table), the process carried out when the image forming apparatus (fixation unit) is in the cleaning mode will be described. FIG. 20 is a flowchart of the operation of the image forming apparatus in this embodiment when the apparatus is in its cleaning mode. FIGS. 21 and 22 are graphical timetables that show the timing of the toner movements on the sheets P1 and P2, the fixation roller 30, the film 16, and the pressure roller 17, and the timing of the temperature changes of the fixation roller 30. Shown in FIG. 21 are the operational steps in the period from when the sheet P1 is conveyed into the fixation unit to when the sheet P1 is discharged from the fixation unit. Shown in FIG. 22 are the operations steps in the period from when the sheet P2 is conveyed into the fixation unit to when the sheet P2 is discharged from the fixation unit.

The image forming apparatus is started in the cleaning mode (Step 1-*a*). Then, a target temperature and process speed are set (Step 1-*b*). The target temperature level is to be high enough to generate the amount of heat Qh, which is large enough to cause the toner on the sheet P1 to "hot offset". The process speed is to be proper to allow the toner on the sheet P to satisfactorily "hot offset".

Next, each of various components involved with the cleaning mode begin to be driven, and electric power begins to be sent to the heater 15 (Step 1-*c*). As the temperature of the fixation roller 30 climbs to a preset level, the sheet P1 is fed into the apparatus main assembly 101 (Step 1-*d*). Then, an unfixed image for cleaning is formed on the sheet P1 (Step 1-*e*).

The sheet P1 is conveyed to the fixation unit (Step 1-*f*), and the unfixed image on the sheet P, which is for the generation of the offset toner To, reaches the fixation nip N1. As the unfixed image on the sheet P1 is conveyed through the fixation nip N1, the toner, of which the unfixed image is formed, turns into the offset toner To, and transfers onto the fixation roller 30 (Step 1-*g*).

Then, as the fixation roller 30 is rotated, the offset toner To on the fixation roller 30 reaches the fixation roller heating nip N2, in which it comes into contact with the film 16, thereby causing the contaminant toner Tc on the film 16 to transfer onto the fixation roller 30 (Step 2-*a*).

Next, as the fixation roller 30 rotates further, the combination of the contaminant toner Tc and the offset toner To reach the fixation nip N1.

As the combination of the contaminant toner Tc and the offset toner To reaches the fixation nip N1, a part of the combination is fixed to the sheet P1, and the rest remains on the fixation roller 30, along with the fresh supply of the offset toner To having just been generated from the unfixed image on the sheet P1, which is for the generation of the offset toner To, and been transferred onto the fixation roller 30. Thus, after the passage of the sheet P1 through the fixation nip N1, at least the offset toner To which is traceable to the unfixed toner image formed across the trailing end portion of the sheet P1 is present on the fixation roller 30.

As soon as the sheet P1 comes out of the fixation nip N1 (Step 2-*b*), the heater 15 is changed in target temperature (Step 2-*c*), whereby the fixation roller 30 is changed in temperature. The new target temperature level is such that gives the sheet P2 the amount of heat Qn, which is the same amount of heat given to a sheet of recording media when the image forming apparatus (fixation unit) is in the ordinary fixation mode.

As the fixation roller 30 rotates further, the offset toner To reaches the fixation nip N1, in which it comes into contact with the pressure roller 17, thereby causing the contaminant toner Tc having adhered to the pressure roller 17, to transfer onto the fixation roller 30 (Step 2-*d*).

Until the sheet P2 is conveyed to the fixation unit, the offset toner To on the fixation roller 30 remains on the peripheral surface of the fixation roller 30, and therefore, is repeatedly moved through the fixation nip N1 and the fixation roller heating nip N2, while continuously cleaning the pressure roller 17 and the film 16, respectively. The slippery layer of the film 16 and the slippery layer of the pressure roller 17 are made slipperier than the slippery layer of the fixation roller 30. Therefore, the offset toner To can clean the pressure roller 17 and the film 16 while remaining on the peripheral surface of the fixation roller 30.

It is possible that if, for some reason, the temperature of the pressure roller 17 does not climb high enough, a part of the offset toner To and the like on the fixation roller 30 will transfer onto the pressure roller 17. However, even if a part of the offset toner To and the like on the fixation roller 30 transfers onto the pressure roller 17, it is discharged from the fixation unit by being transferred from the pressure roller 17 onto the back side of the sheet P2 in Step 3-*a* and the steps thereafter.

During the period from when the sheet P1 is discharged from the fixation unit to when the sheet P2 is conveyed to the fixation unit, the film-cleaning performance of the fixation unit decreases. However, the contaminant toner Tc removed from the film 16 while the sheet P1 is conveyed through the fixation unit can be discharged even during this period.

The contaminant toner Tc having adhered to the pressure roller 17 can also be discharged by fixing it to the back side of the sheet P2 with the utilization of the adhesiveness of the offset toner To having adhered to the pressure roller 17, through Step 3-*a* and the steps thereafter.

Next, the sheet P2 is fed into the apparatus main assembly 101 (Step 3-*a*). Then, an unfixed image for recovery is formed on the sheet P2 (Step 3-*b*). This sheet P2 is conveyed to the fixation unit (Step 3-*c*).

The contaminant toner Tc and the offset toner To on the fixation roller 30 are fixed to the sheet P2 in the fixation nip N1 (Step 3-*d*).

The image for recovery, which is on the sheet P2, reaches the fixation nip N1, in which the contaminant toner Tc and the offset toner To are fixed to the sheet P2, along with the image for recovery (Step 3-*e*).

Then, this sheet P2 is discharged (Step 3-*f*). Then, the electric power to the heater 15 is turned off, and the image forming apparatus is stopped, ending thereby the operation in the cleaning mode (Step 3-*g*).

(Test Results)

A test was carried out to confirm the effectiveness of the fixation unit in this embodiment in the cleaning mode. The image forming apparatus and fixation unit used for the test were the same as those in the first embodiment.

The fixation unit in this embodiment was tested in terms of the effectiveness with which it removed the contaminant toner Tc having adhered to the film 16, and the contaminant toner Tc having adhered to the pressure roller 17, in the same manner as the manner in which the fixation unit in the first embodiment was tested.

As the image forming apparatus was started in the cleaning mode, the process speed was set to 45 mm/sec, which was half the process speed in the ordinary fixation mode. Then, an image forming operation was started, and also, the fixation roller 30 of the fixation unit began to be driven. The ceramic heater 15 was controlled so that its temperature remained in a range of 200° C.-220° C.

Then, sending of electric power to the ceramic heater 15 was started. Then, the image forming apparatus was kept on standby, for 10 seconds~5 minutes, while continuously sending electric power to the ceramic heater 15. Then, the sheet P1 was conveyed into the fixation nip N1 of the fixation unit.

Incidentally, if the image forming apparatus begins to be operated in the cleaning mode after the fixation unit cools down, the apparatus is to be kept on standby longer than when the apparatus is started in the cleaning mode while the fixation unit is still warm. While the apparatus is kept on standby, the temperature of the film 16 will have climbed to 190° C. -210° C., and the temperature of the fixation roller 30 will have climbed to 180° C.-200° C. Further, the temperature of the pressure roller 17 will have climbed to 140° C.-150° C. The pattern of the image for the cleaning mode was the same as the one in the first embodiment.

As the cleaning sheet P1 for generating the offset toner To, a sheet of LBP printing paper (product of) which was 80 g/m$^2$ in basis weight and A4 in size was conveyed into the image forming portion, in which an unfixed toner image for the cleaning mode was formed on the cleaning sheet P1. Then, the sheet P1 was conveyed into the fixation nip N1. As for the pattern of the image formed on the sheet P1 for the cleaning mode, the portion of the sheet P1, which was between the leading edge of the sheet P1 to a hypothetical straight line on the sheet P1, which was perpendicular to the sheet conveyance direction and was 70 mm apart from the leading edge, was left as a blank (white) space, and the portion of the sheet P1, which was between the abovementioned hypothetical straight line which was 70 mm apart from the leading edge and the trailing edge of the sheet P1, was covered with a solid monochromatic image which was formed of black toner with a width of 200 mm and had a 100% print ratio. The toner on the sheet P1 was "hot offset" onto the fixation roller 30, becoming the offset toner To, in the fixation nip N1.

As the sheet P1 came out of the fixation nip N1, the process speed was changed to 90 mm/sec, and the target temperature of the ceramic heater 15 was changed to 180° C.-200° C. This target temperature range was such a range that was able to provide the toner on the sheet P2 with a proper amount of heat, that is, such an amount of heat that did not cause either under-fixation or "hot offset". When the fixation roller 30 and the pressure roller 17 were cold (having cooled down), the target temperature for the ceramic heater 15 was set relatively high, whereas when they were warm, it was set relatively low, as it was in the ordinary fixation mode.

At this point of the cleaning operation, the temperature of the film 16 was in a range of 170° C.-190° C., and the temperature of the fixation roller 30 was in a range of 160° C.-180° C. Further, the temperature of the pressure roller 17 was in a range of 90° C.-110° C.

Incidentally, as the contaminant toner Tc collects on the film 16, it occurs sometimes that the contaminant toner Tc peels away from the film 16, adheres to the fixation roller 30, transfers from the fixation roller 30 to the pressure roller 17, and adheres to the pressure roller 17. It also occurs sometimes that the contaminant toner Tc collects on the pressure roller 17.

By the time the cleaning sheet P2 was introduced into the fixation nip N1 after the passage of the fixation nip N1 of the cleaning sheet P1 through the fixation nip N1, the fixation roller 30, the pressure roller 17, and the film 16 were fully rotated five times. During this period, the contaminant toner Tc having adhered to the film 16 and the contaminant toner Tc having adhered to the pressure roller 17 were transferred onto the fixation roller 30.

Next, as the cleaning sheet P2 for recovering the offset toner To, a sheet of LBP printing paper (product of) which was 80 g/m$^2$ in basis weight and A4 in size was conveyed into the image forming portion, in which an unfixed toner image for the cleaning mode was formed on the cleaning sheet P2. Then, the sheet P2 was conveyed into the fixation nip N1. As for the pattern of the image formed on the sheet P2 for the cleaning mode, the portion of the sheet P2, which was between the leading edge of the sheet P2 and a hypothetical straight line on the sheet P2, which was perpendicular to the sheet conveyance direction and was 70 mm apart from the leading edge, was left as a blank (white) space, and the portion of the sheet P2, which was between the abovementioned hypothetical straight line which was 70 mm apart from the leading edge and the trailing edge of the sheet P2, was covered with a solid monochromatic image which was formed of a combination of cyan toner and magenta toner with a width of 200 mm and a 200% print ratio.

Then, the offset toner To and the contaminant toner To on the fixation roller 30 were recovered onto the sheet P2 while fixing the image on the sheet P2, which was for recovering the offset toner To, without allowing the image to "hot offset", in the fixation nip N1.

The results of this operation in the cleaning mode were as follows: Among the contaminants such as the contaminant toner Tc having adhered to the film 16, those that had not solidly adhered to the film 16 were removed. Further, it did not occur that the rest of the contaminants pealed from the film 16 and transferred onto the sheet P2 when the image forming apparatus operated in the normal fixation mode. In other words, this embodiment of the present invention also was excellent in effectiveness in the fixation mode. Further, among the contaminants having adhered to the pressure roller 17, those that had not have solidly adhered to the pressure roller 17 were removed.

Embodiment 5

Next, the image forming apparatus (fixation unit) in the fifth embodiment of the present invention will be described. The basic structure of the apparatus in this embodiment is the same as those of the apparatuses in the preceding embodiments. Therefore, the portions of the structure of the apparatus in this embodiment, which are the same in function as those in the preceding embodiments will not be described. Further, the components, portions, etc., which are the same in function as the counterparts in the preceding embodiments will be given the same reference characters codes as those given to their counterparts in the preceding embodiments.

In the case of the image forming apparatus in the fourth embodiments described above, which was capable of printing on both surfaces of a sheet of recording media, the cleaning operation was carried out using the sheet P1, which was for generating the offset toner To, and the sheet P2, which was for recovering the offset toner To. In this embodiment, one of the two surfaces of the sheet P was used to adhere the offset toner To to the fixation roller 30. Then, as the sheet P was discharged from the fixation unit, it was turned over, and an image for recovering the offset toner To was formed on the other surface of the sheet P. In other words, the sheet P used for adhering the offset toner To to the fixation roller 30 was also used for recovering the offset toner To and the contaminant toner Tc on the fixation roller 30.

An image for generating the offset toner To is formed on the sheet P in the image forming portion. Then, this sheet P is conveyed to the fixation nip N1, in which the amount of heat given the toner on the sheet P is Qh, which is large enough to cause the toner on the sheet P to "hot offset", thereby adhering toner to the fixation roller 30. Then, the target temperature for the fixation unit, and the process speed of the apparatus are changed. While the sheet P is conveyed through the fixation nip N1, a part of the unfixed toner on the sheet P is transferred ("hot offset") onto the fixation roller 30, and the rest is fixed, as "residual toner image", to the sheet P. After the adhering of the offset toner To to the fixation roller 30, the sheet P is discharged from the fixation unit, and then, is turned over by an automatic sheet turning mechanism with which the image forming apparatus is provided, or is manually turned over by a user. Then, the sheet P is conveyed again into the image forming portion, with its surface having "residual toner image" facing opposite from the direction in which it was facing when the sheet P is conveyed through the image forming portion for the first time.

Then, an image for recovering the offset toner To is formed on the second surface of the sheet P in the image forming portion. Then, this sheet P is conveyed to the fixation nip N1. In the fixation nip N1, the offset toner To and the contaminant toner Tc adhered to the fixation roller 30 are recovered by the sheet P while the image for recovering the offset toner To is fixed by giving the amount of heat Qn to the toner on the sheet P, which is the same as the amount of heat given to the toner on a sheet of recording media when the apparatus is in the ordinary fixation mode, that is, the amount which does not cause either under-fixation or "hot offset". During this operational period, the fixed "residual toner image" on the first surface of the sheet P is melted, thereby becoming adhesive, and removes the contaminant toner To on the pressure roller 17 by coming into contact with the pressure roller 17.

Also in this embodiment, it is desired that by the time the sheet P is introduced into the fixation nip N1 for the second time after the passage of the sheet P through the fixation nip N1, the fixation roller 30, the film 16, and the pressure roller 17 are fully rotated two or more times, as in the fourth embodiment.

This embodiment was able to highly effectively clean the fixation unit with the use of only a single sheet of recording media. Further, it was able to clean the pressure roller 17 more effectively than the preceding embodiments.

Figure 23:
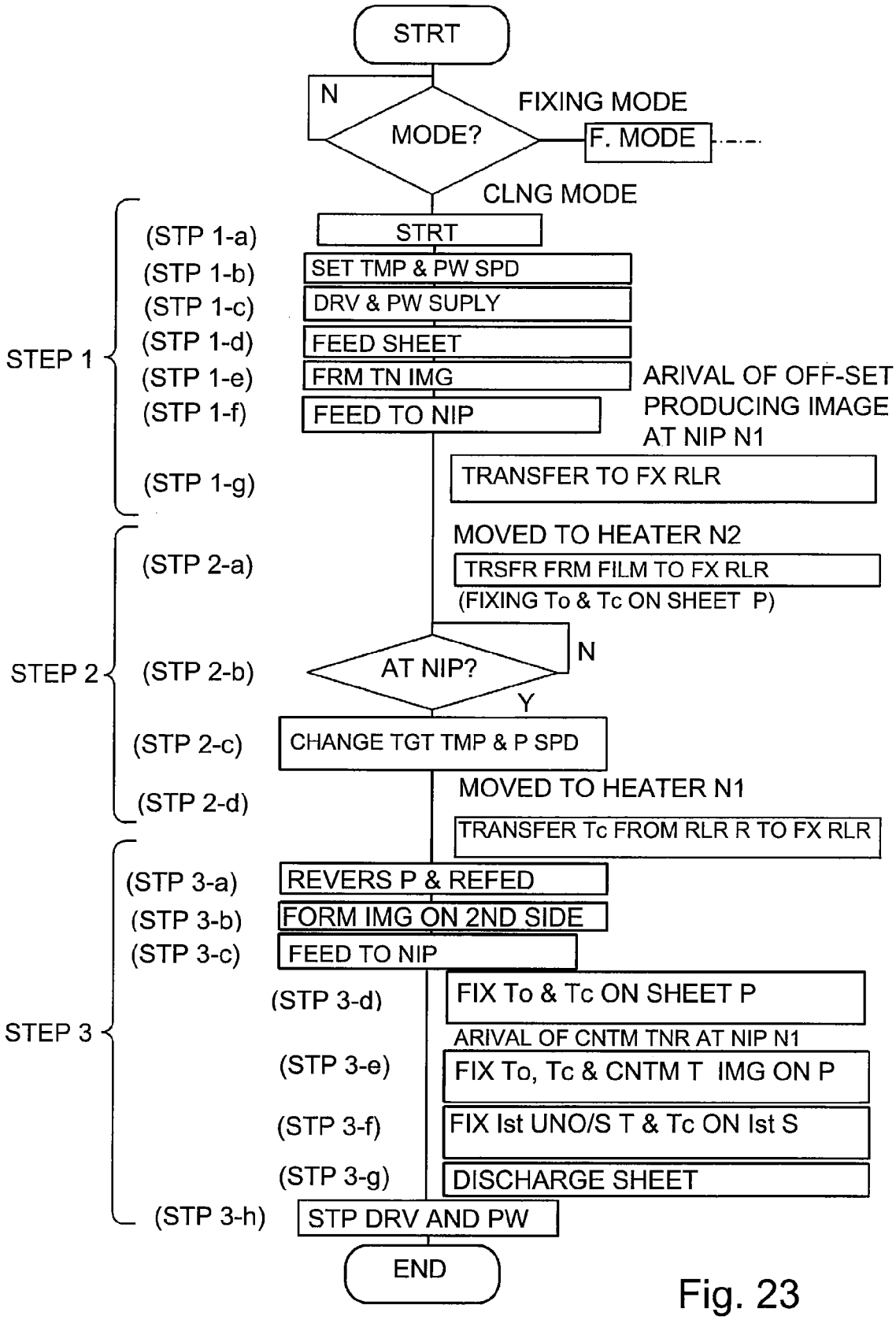
FIG. 23 is a flowchart of the cleaning operation in the fifth embodiment of the present invention.
Figure 24:
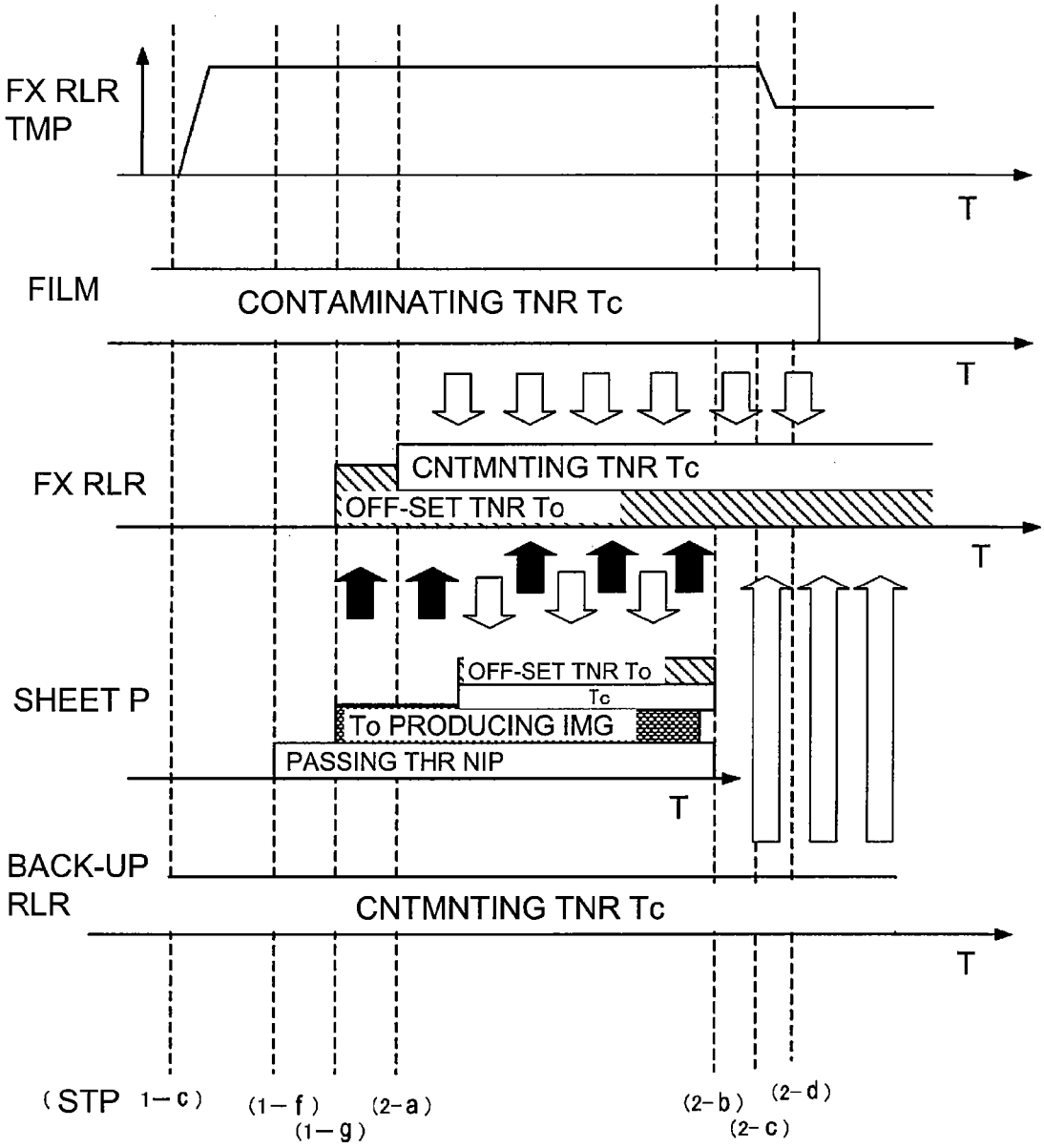
FIG. 24 is a graphic time table which shows the toner movements and the like on the first surface of a sheet of the recording media, which occur when the sheet of the recording medium is conveyed through the fixation nip in the fifth embodiment.
Figure 25:
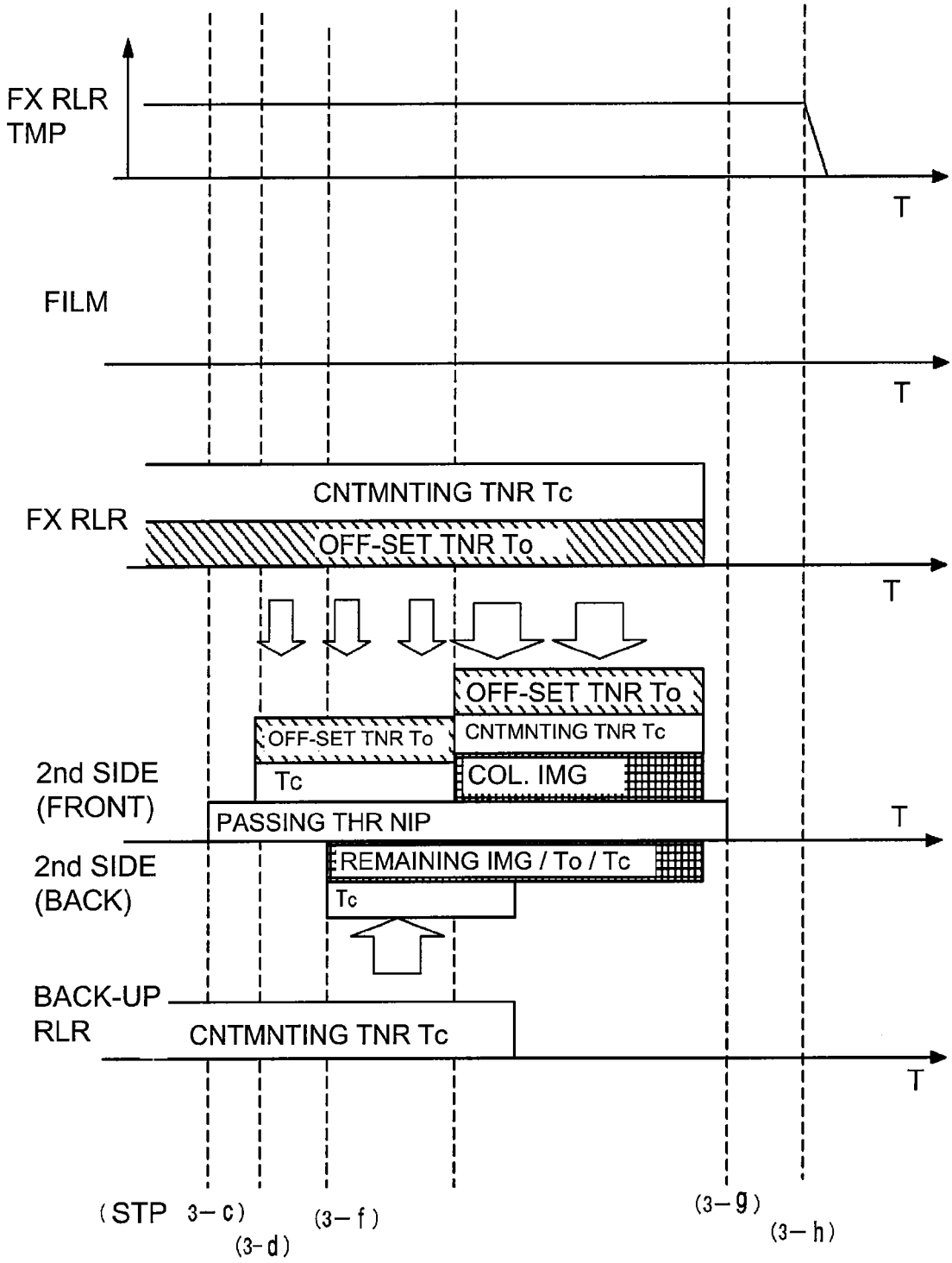
FIG. 25 is a graphic timetable that shows the toner movements and the like on the second surface of the sheet of the recording media in the fifth embodiment.
Figure 26:
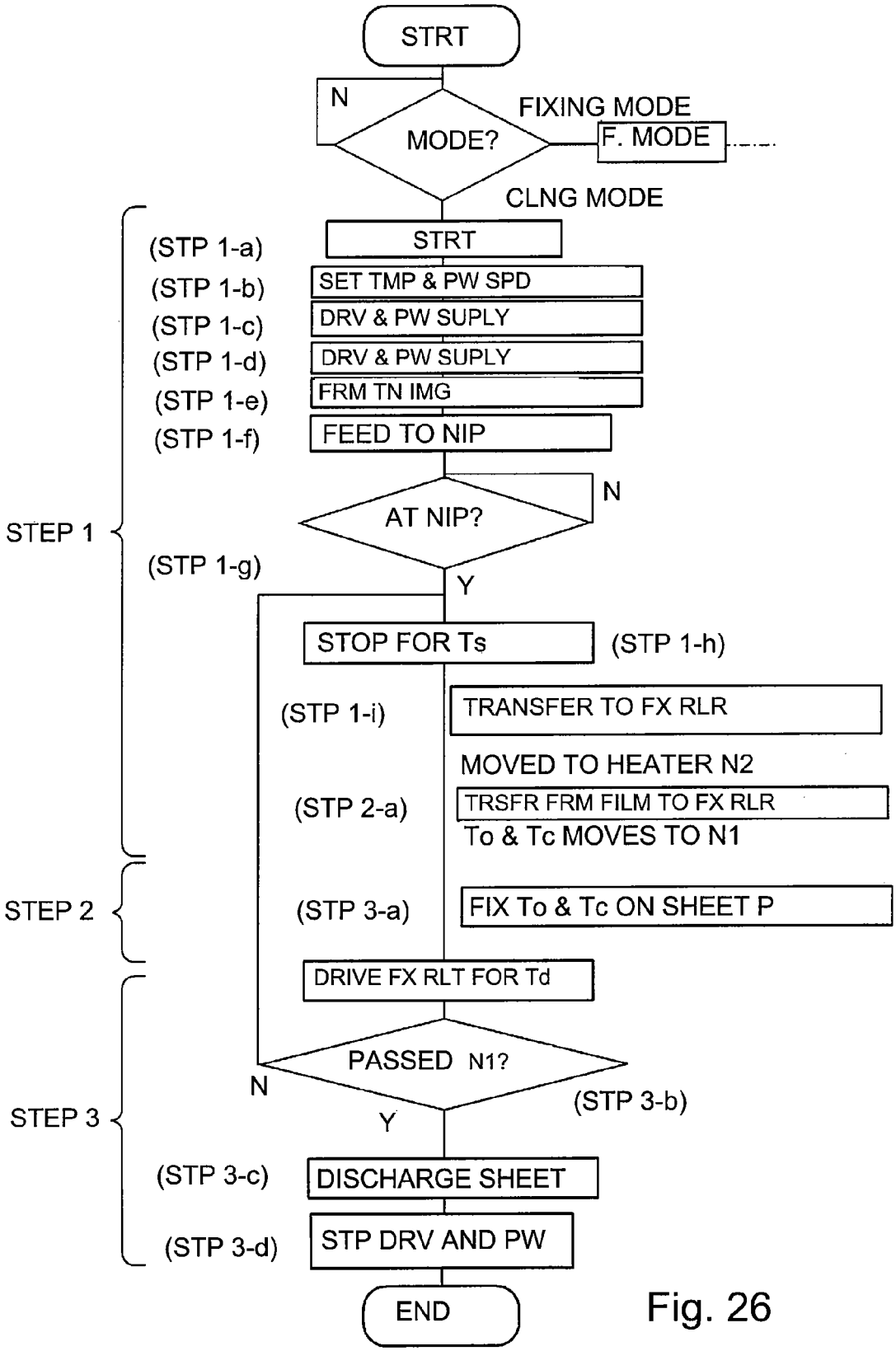
FIG. 26 is a flowchart of the cleaning operation in the sixth embodiment of the present invention.

Next, referring to FIG. 23 (flowchart), 24 (time table), and 25 (time table), the process carried out in the cleaning mode in this embodiment will be described. FIG. 23 is a flowchart of the operation of the image forming apparatus in the cleaning mode in this embodiment. FIGS. 24 and 25 are graphic timetables that show the toner movements on the sheet P, the fixation roller 30, the film 16, and the pressure roller 17, and the temperature changes of the fixation roller 30.

FIG. 24 shows the operational period in which the sheet P is introduced the first time into the fixation unit, is discharged therefrom, is turned over, and then, is introduced into the fixation unit for the second time. FIG. 25 shows the operational period from when the turned sheet P is introduced into the fixation unit to when the turned sheet P is discharged from the fixation unit.

The image forming apparatus is started in the cleaning mode (Step 1-*a*). Then, the target temperature and the process speed are set (Step 1-*b*). The target temperature level is to be high enough to generate the amount of heat Qh, which is large enough to cause the toner on the sheet P to "hot offset". The process speed is to be proper to allow the toner on the sheet P to satisfactorily "hot offset".

Next, each of various components involved with the cleaning mode begin to be driven, and electric power begins to be sent to the heater 15, whereby the temperature of the fixation roller 30 climbs to a preset level (Step 1-*c*). Next, the sheet P is fed into the apparatus main assembly 101 (Step 1-*d*). Then, an unfixed image for cleaning is formed on the sheet P (Step 1-*e*).

This sheet P is conveyed to the fixation unit (Step 1-*f*), and the unfixed image on the sheet P, which is for the generation of the offset toner To, reaches the fixation nip N1. As the unfixed image on the sheet P is conveyed through the fixation nip N1, the toner, of which the unfixed image is formed, turns into the offset toner To, and transfers onto the fixation roller 30. The toner that does not "hot offset" is fixed to the sheet P (Step 1-*g*). Hereafter, the fixed image formed of the toner that did not "hot offset" will be referred to as a residual image.

As the fixation roller 30 rotates, the offset toner To on the fixation roller 30 reaches the fixation roller heating nip N2, in which it comes into contact with the film 16, whereby it transfers the contaminant toner Tc on the film 16, onto the fixation roller 30 (Step 2-*a*).

Next, as the fixation roller 30 rotates further, the combination of the contaminant toner Tc and the offset toner To reaches the fixation nip N1.

A part of the combination of the contaminant toner Tc and the offset toner To is fixed to the sheet P, and the rest remains on the fixation roller 30, along with the new supply of the offset toner To generated by the unfixed image for offset toner generation, which is on the sheet P. After the passage of the sheet P through the fixation nip N1, at least the offset toner To, which is traceable to the portion of the unfixed image, which is formed on the trailing end portion of the sheet P, will have adhered to the fixation roller 30.

After the passage of the sheet P through the fixation nip N1, there will be the abovementioned residual image, the offset toner To, the contaminant toner Tc, etc., on the sheet P.

After the passage of the sheet P through the fixation nip N1 (Step 2-*b*), the temperature of the fixation roller 30 is changed by changing the target temperature of the heater 15 (Step 2-*c*). The temperature level to which the target temperature of the heater 15 is changed is such a level that the amount of heat Qn given to the toner, which is the same as the amount of heat given to the toner when the apparatus is in the ordinary fixation mode.

As the fixation roller 30 rotates, the offset toner To reaches the fixation nip N1, in which it comes into contact with the pressure roller 17, thereby causing the contaminant toner Tc to transfer onto the fixation roller 30 (Step 2-*d*).

Until the sheet P is conveyed to the fixation unit, the offset toner To on the fixation roller 30 remains on the peripheral surface of the rotating fixation roller 30, being therefore repeatedly put through the film heating nip N2 and the fixation nip N1 while cleaning the film 16 and the pressure roller 17, respectively. The peripheral layer (slippery layer) of the film 16, and the peripheral layer (slippery layer) of the pressure roller 17, are slipperier than that of the fixation roller 30. Thus, the offset toner To on the fixation roller 30 can clean the film 16 and the pressure roller 17 while remaining on the peripheral surface of the fixation roller 30.

Even if the offset toner To having adhered to the fixation roller 30 transfers onto the pressure roller 17, it is removed from the pressure roller 17 as it was in the fourth embodiment.

As the sheet P comes out of the fixation unit, it is turned over by the automatic sheet turning mechanism, and is re-fed into the apparatus main assembly 101 (Step 3-*a*). Then, an unfixed image for contaminant recovery is formed on the second surface of the sheet P (Step 3-*b*). This sheet P is conveyed to the fixation unit (Step 3-*c*).

The contaminant toner Tc and the offset toner To on the fixation roller 30 are fixed to the second surface of the sheet P in the fixation nip N1 (Step 3-*d*). Then, the contaminant recovery image on the sheet P reaches the fixation nip N1, in which the contaminant toner Tc and the offset toner To are fixed to the second surface of the sheet P, along with the contaminant recovery image (Step 3-*e*).

Then, the fixed residual image, etc., on the first surface of the sheet P reaches the fixation nip N1, and comes into contact with the pressure roller 17, whereby it removes the contaminant toner Tc on the pressure roller 17 (Step 3-*f*).

Then, the sheet P is discharged (Step 3-*g*). Then, heater 15 is turned off, and the image forming apparatus is stopped, ending the operation in the cleaning mode (Step 3-*h*).

(Test Results)

A test is carried out to confirm the effectiveness of the fixation unit in this embodiment in the cleaning mode. The image forming apparatus and the fixation unit used for the test are the same as those in the first embodiment. However, the image forming apparatus in this embodiment was provided with an automatic sheet turning mechanism so that after an image is fixed to one (first) of the two surfaces of the sheet P, the sheet P is automatically turned over, is introduced into the image forming apparatus for the second time, and an image is formed on the second surface of the sheet P.

The performance of the image forming apparatus (fixation unit) in this embodiment was tested in terms of the removal of the contaminant toner Tc having adhered to the film 16, and the removal of the contaminant toner Tc having adhered to the pressure roller 17, as the performance of the image forming apparatus in the first embodiment was tested.

As the image forming apparatus was started in the cleaning mode, the process speed was set to 45 mm/sec, which was half the process speed in the ordinary fixation mode. Then, an image forming operation was started, and also, the fixation roller 30 of the fixation unit began to be driven. The ceramic heater 15 was controlled so that its temperature remained in a range of 200° C.-220° C.

Then, sending of electric power to the ceramic heater 15 was started. Then, the image forming apparatus was kept on standby for 10 seconds-5 minutes, while continuously sending electric power to the ceramic heater 15. Then, the sheet P was conveyed into the fixation nip N1 of the fixation unit.

Incidentally, if the image forming apparatus begins to be operated in the cleaning mode after the fixation unit cools down, the apparatus is to be kept on standby longer than when the apparatus is started in the cleaning mode while the fixation unit is still warm. While the apparatus is kept on standby, the temperature of the film 16 will have climbed to 190° C. -210° C., and the temperature of the fixation roller 30 will have climbed to 180° C.-200° C. Further, the temperature of the pressure roller 17 will have climbed to 140° C.-150° C. The pattern of the image for cleaning mode was the same as the one in the first embodiment.

As the cleaning sheet P for generating the offset toner To, a sheet of LBP printing paper (product of) which was 80 g/m$^2$ in basis weight and A4 in size was conveyed into the image forming portion, in which an unfixed toner image for the cleaning mode was formed on one of the two surfaces of the cleaning sheet P. Then, the sheet P was conveyed into the fixation nip N1. As for the pattern of the image formed on the sheet P for the cleaning mode, the portion of the sheet P, which was between the leading edge of the sheet P1 and a hypothetical straight line on the sheet P, which is perpendicular to the sheet conveyance direction and was 70 mm apart from the leading edge, was left as a blank (white) space, and the portion of the sheet P, which was between the abovementioned hypothetical straight line which was 70 mm apart from the leading edge and the trailing edge of the sheet P, was covered with a solid monochromatic image which was formed of black toner with a width of 200 mm and a 100% print ratio. The toner on the sheet P was "hot offset" onto the fixation roller 30, becoming the offset toner To, in the fixation nip N1.

As the sheet P came out of the fixation nip N1, the process speed was changed to 90 mm/sec, and the target temperature of the ceramic heater 15 was changed to 180° C.-200° C. This target temperature range was such a range that was able to provide the toner on the sheet P with a proper amount of heat, that is, such an amount of heat that did not cause either under-fixation or "hot offset" when the process speed was 90 mm/sec. When the fixation roller 30 and the pressure roller 17 were cold (having cooled down), the target temperature for the ceramic heater 15 was set relatively high, whereas when they were warm, it was set relatively low, as it was in the ordinary fixation mode. At this point of the cleaning operation, the temperature of the film 16 was in a range of 170° C.-190° C., and the temperature of the fixation roller 30 was in a range of 160° C.-180° C. Further, the temperature of the pressure roller 17 was in a range of 90° C.-110° C.

After the sheet P was discharged from the fixation unit, it was turned over by the automatic sheet turning mechanism, and was sent to the image forming portion for the second time.

In the image forming portion, an unfixed toner image for contaminant recovery was formed on the sheet P. Then, the sheet P was conveyed into the fixation nip N1 of the fixation unit. As for the pattern of the image for the cleaning mode, the portion of the sheet P, which was between the leading edge of the sheet P and a hypothetical straight line on the sheet P, which was perpendicular to the sheet conveyance direction and was 70 mm apart from the leading edge, was left as a blank (white) space, and the portion of the sheet P, which was between the abovementioned hypothetical straight line which was 70 mm apart from the leading edge and the trailing edge of the sheet P, was covered with a solid monochromatic image which was formed of a combination of cyan toner and magenta toner with a width of 200 mm and a 200% print ratio.

The results of this operation in the cleaning mode were as follows: Among the contaminants such as the contaminant toner Tc having had adhered to the film 16, those which had not solidly adhered to the film 16 were removed. Further, it did not occur that the rest of the contaminants peeled from the film 16 and transferred onto the sheet P when the image forming apparatus was operated in the ordinary fixation mode. In other words, this embodiment of the present invention also was very effective to clean the fixation unit.

Further, it was also possible to remove the contaminant toner Tc having had adhered to the pressure roller 17.

Embodiment 6

Next, the image forming apparatus (fixation unit) in the sixth embodiment of the present invention will be described. The basic structure of the apparatus in this embodiment is the same as those of the apparatuses in the preceding embodiments. Therefore, the portions of the structure of the apparatus in this embodiment, which are the same in function as those in the preceding embodiments will not be described. Further, the components, portions, etc., which are the same in function as their counterparts in the preceding embodiments will be given the same reference characters as those given to their counterparts in the preceding embodiments.

In this embodiment, the fixation unit is cleaned by intermittently conveying the cleaning sheet P through the fixation unit.

To describe more concretely the operation carried out by the image forming apparatus in this embodiment when the apparatus is in the cleaning mode, as the apparatus is started in the cleaning mode, the target temperature of the ceramic heater 15 of the fixation unit 109 is set to the temperature level for the cleaning mode, and the process speed of the apparatus is set to a preset value. Then, the driving of the fixation roller 30 is started, and the ceramic heater is turned on.

Then, the image forming apparatus begins an image forming operation. As the image forming operation is started, the sheet P is fed into the apparatus main assembly 101 from the sheet feeder cassette 102, and is sent to the image forming portion 108, by the pair of sheet feeding-and-conveying roller 105. In the image forming portion 108, an image for the cleaning mode is formed on the sheet P. The image for the cleaning mode in this embodiment is the same in pattern as that in the first embodiment.

As the unfixed image on the sheet P enters the fixation nip N1 by a preset length, the fixation roller 30 is stopped from rotating, and is kept stationary for a preset length of time. Then, the sheet P is conveyed again by rotating the fixation roller 30 by an angle that is equivalent to the width of the fixation nip N1 in terms of the sheet-conveyance direction. Then, the fixation roller 30 is stopped again. That is, the sheet P is intermittently conveyed by repeating the alternate rotation and stopping of the fixation roller 30. Then, as the trailing edge of the sheet P approaches the fixation nip N1, the fixation roller 30 is continuously rotated to discharge the sheet P.

While the fixation roller 30 is kept stationary, it gives the amount of heat to the toner on the sheet P that is large enough to cause the unfixed toner to "hot offset" onto the fixation roller 30.

The offset toner To on the fixation roller 30 is intermittently moved through the fixation roller heating nip N2 by the repetitive and alternate rotation and stopping of the fixation roller 30, while transferring the contaminant toner Tc on the film 16 onto the fixation roller 30. Then, the combination of the offset toner To and the transferred contaminant toner Tc on the fixation roller 30 reaches the fixation nip N1, while being intermittently moved by the repetitive and alternate rotation and stopping of the fixation roller 30. Then, the combination is recovered by being fixed to the sheet P in the fixation nip N1.

In this embodiment, the cleaning sheet P is intermittently moved through the fixation nip N1. Therefore, the length of time the fixation roller 30 and the sheet P remain in contact with each other in the fixation nip N1, and the length of time the fixation roller 30 and the film 16 remain in contact with each other, are longer than those in the preceding embodiments.

Thus, this embodiment can more effectively transfer the contaminant toner Tc from the film 16 onto the fixation roller 30, and recover the offset toner To and the contaminant toner Tc having adhered to the fixation roller 30 onto the sheet P. In other words, this embodiment can more effectively clean the fixation unit.

Further, in a case where the contaminant toner Tc had adhered to the pressure roller 17, more time is available to melt the contaminant toner Tc to clean the film 16 by welding the contaminant toner Tc to the reverse surface of the sheet P.

Next, referring to FIG. 16 (flowchart), the process carried out to test this embodiment will be described.

The image forming apparatus was started in the cleaning mode (Step 1-*a*). Then, target temperature and process speed were set (Step 1-*b*). Next, each of various components involved with the cleaning mode began to be driven, and electric power began to be sent to the heater 15, whereby the temperature of the fixation roller 30 climbed to a preset level (Step 1-*c*).

Next, the sheet P was fed into the apparatus main assembly 101 (Step 1-*d*). Then, an unfixed image for cleaning was formed on the sheet P (Step 1-*e*). This sheet P is conveyed to the fixation unit (Step 1-*f*).

As the unfixed image on the sheet P reached the fixation nip N1 (Step 1-*g*), the intermittent conveyance of the sheet P was started (Step 1-*h*). That is, as the unfixed image reached the fixation nip N1, the fixation roller 30 was stopped, and kept stationary for a preset length Ts of time. Then, the fixation roller 30 is rotated for a length Td of time, which is equivalent to the width of the fixation nip N1 in terms of the sheet conveyance direction, to convey the sheet P. Then, the fixation roller 30 is stopped again. This combination of the alternate stopping and rotation of the fixation roller 30 is repeated to intermittently convey the sheet P through the fixation nip N1.

In the fixation nip N1, the unfixed image on the sheet P is turned into the offset toner To, and transfers onto the fixation roller 30 (Step 1-*i*). Then, as the fixation roller 30 rotates further, the offset toner Tc on the fixation roller 30 reaches the fixation roller heating nip N2, in which it comes into contact with the film 16, thereby causing the contaminant toner Tc on the film 16 to transfer onto the fixation roller 30 (Step 2-*a*).

Then, as the fixation roller 30 rotates further, the contaminant toner Tc and the offset toner To reach the fixation nip N1, in which they are fixed to the sheet P (Step 3-*a*).

Then, as the trailing edge of the sheet P approaches the fixation nip N1, and a preset hypothetical line on the sheet P, which is perpendicular to the sheet conveyance direction, comes out of the fixation nip N1, the rotation of the fixation roller 30 is continued until the sheet P is discharged (Step 3-*b*), discharging thereby the sheet P (Step 3-*c*). Then, the electric power to the heater 15 is turned off, and the image forming apparatus is stopped (Step 3-*d*), ending the image forming operation in the cleaning mode.

(Test Results)

A test was carried out to confirm the effectiveness of the fixation unit in this embodiment in the cleaning mode. The image forming apparatus and the fixation unit used for the test were the same as those in the first embodiment.

The fixation unit in this embodiment was tested in terms of the effectiveness with which it removed the contaminant toner To having adhered to the film 16, in the same manner as the manner in which the fixation unit in the first embodiment was tested.

As the image forming apparatus in this embodiment began to be operated in the cleaning mode, the image forming apparatus began an image forming operation, and the fixation roller 30 of the fixation unit 30 began to be driven. The ceramic heater 15 was controlled so that its temperature remained at a target level of 200° C. The cleaning sheet P used to test the fixation unit in this embodiment was a sheet of ordinary LBP printing paper (product of), which was 80 g/m$^2$ in basis weight, and A4 in size. The sheet P was conveyed to the image forming portion, and an unfixed toner image for the cleaning mode was formed on the sheet P in the image formation portion. Then, the sheet P was conveyed into the fixation nip N1 of the fixation unit. The pattern of the image for cleaning was the same as that in the first embodiment.

In this test, the rotation of the fixation roller 30 was stopped at the moment when a hypothetical line on the sheet P, which was parallel to the leading edge of the sheet P and was 76 mm apart from the leading edge, that is, the leading edge of the image for generating the offset toner To, entered the fixation nip N1. Then, the fixation roller 30 was kept stationary for three seconds. Then, it was rotated again to convey the sheet P by a distance equal to the width of the fixation nip N1 in terms of the sheet conveyance direction, and was stopped again. This rotation and stopping of the fixation roller 30 was repeated 24 times to convey the sheet P until a hypothetical line on the sheet P, which was parallel to the leading edge of the sheet P and was 220 mm apart from the leading edge, entered the fixation nip N1. Thereafter, the fixation roller 30 was continuously rotated to discharge the sheet P.

The results of this test operation in the cleaning mode were as follows: Among the contaminants such as the contaminant toner Tc having had adhered to the film 16, those which had not solidly adhered to the film 16 were removed. Further, it did not occur that the rest of the contaminants peeled from the film 16 and transferred onto the sheet P when the image forming apparatus was in the normal fixation mode. In other words, this embodiment of the present invention also was excellent in effectiveness in the fixation mode. Further, it was possible to remove the contaminant toner Tc having adhered to the pressure roller 17.

While the invention has been described with reference to the structures disclosed herein, it was not confined to the details set forth, and this application is intended to cover such modifications or changes as may come within the purposes of the improvements or the scope of the following claims.

This application claims priority from Japanese Patent Application No. 097636/2009 filed Apr. 14, 2009 which is hereby incorporated by reference.

What is claimed is:

1. An image forming apparatus for forming a toner image on a sheet, said image forming apparatus comprising:

a fixing unit including a fixing roller, a back-up member configured to cooperate with said fixing roller to form a nip therebetween, and a rotatable heating member contactable to a surface of said fixing roller to heat said fixing roller, wherein the sheet is outputted from said image forming apparatus after an unfixed toner image is fixed on the sheet, wherein said image forming apparatus is operable in a cleaning mode for cleaning said fixing unit, and wherein when the cleaning mode is selected, a predetermined unfixed toner image is formed on the sheet, and the sheet is fed to said fixing unit, and the toner is transferred from the sheet onto said fixing roller in said fixing nip, and then the toner transferred onto said fixing roller is brought into contact with said heating member, and thereafter, the toner on said fixing roller is transferred onto the sheet in said fixing nip.

2. The image forming apparatus according to claim 1, wherein in the cleaning mode, the unfixed toner image on the sheet to be transferred onto said fixing roller has a print ratio of 50-300%.

3. The image forming apparatus according to claim 1, wherein in an operation in a normal mode, a first heat quantity is applied to unfixed toner on the sheet in said fixing nip, and when the cleaning mode is selected, the predetermined unfixed toner image is formed on the sheet, and the sheet is fed to the fixing unit, and then a second heat quantity which is larger than the first heat quantity is applied to the toner on the sheet in said fixing nip to transfer the toner onto said fixing roller.

4. The image forming apparatus according to claim 3, wherein in the cleaning mode, the predetermined unfixed toner image is formed on the sheet, and the sheet is fed to the fixing unit, and then the toner on the sheet is supplied with the second heat quantity in said fixing nip to transfer the toner onto said fixing roller, and the transferred toner is brought into contact to said heating member, and thereafter, the toner on the fixing roller is supplied with a third heat quantity which is smaller than the second heat quantity in said fixing nip to transfer the toner from said fixing roller onto the sheet.

5. The image forming apparatus according to claim 3, wherein in the cleaning mode, when the toner is transferred from the fixing roller onto the sheet, on a part of the sheet from which the toner is transferred onto the fixing roller, a toner image for collection is formed.

6. The image forming apparatus according to claim 5, wherein in the cleaning mode, the toner image for collection extends over a length not less than an outer circumferential length of said heating member which is rotatable, with a print ratio not less than 50%.

7. The image forming apparatus according to claim 1, wherein the strength of adhesion between said heating member and toner is less than that between said fixing roller and toner.

8. The image forming apparatus according to claim 1, wherein said image forming apparatus is capable of forming images on respective sides of the sheet, wherein the unfixed toner image on a first side of the sheet is transferred onto said fixing roller, and the toner is transferred from said fixing roller onto a second side of the sheet.

9. An image forming apparatus for forming an toner image on a sheet, said image forming apparatus comprising:

a fixing unit including a fixing roller, a back-up member configured to cooperate with said fixing roller to form a nip therebetween, and a rotatable heating member contactable to a surface of said fixing roller to heat said fixing roller, wherein the sheet is outputted from said image forming apparatus after an unfixed toner image is fixed on the sheet, wherein said image forming apparatus is operable in a cleaning mode for cleaning said fixing unit, and wherein when the cleaning mode is selected, a predetermined unfixed toner image is formed on a first sheet, and the first sheet is fed to said fixing unit, and the toner is transferred from the first sheet onto said fixing roller in said fixing nip, and then the toner transferred onto said fixing roller is brought into contact with said heating member, and thereafter, the toner on said fixing roller is transferred onto a second sheet in said fixing nip.

10. The image forming apparatus according to claim 9, wherein in the cleaning mode, the unfixed toner image on the first sheet to be transferred onto said fixing roller has a print ratio of 50-300%.

11. The image forming apparatus according to claim 9, wherein in an operation in a normal mode, a first heat quantity is applied to unfixed toner on the sheet in said fixing nip, and when the cleaning mode is selected, the predetermined unfixed toner image is formed on the first sheet, and the first sheet is fed to the fixing unit, and then a second heat quantity which is larger than the first heat quantity is applied to the toner on the first sheet in said fixing nip to transfer the toner onto said fixing roller.

12. The image forming apparatus according to claim 11, wherein in the cleaning mode, the predetermined unfixed toner image is formed on the first sheet, and the first sheet is fed to the fixing unit, and then the toner on the first sheet is supplied with the second heat quantity in said fixing nip to transfer the toner onto said fixing roller, and the transferred toner is brought into contact to said heating member, and thereafter, the toner on the fixing roller is supplied with a third heat quantity which is smaller than the second heat quantity in said fixing nip to transfer the toner from said fixing roller onto the second sheet.

13. The image forming apparatus according to claim 11, wherein in the cleaning mode, when the toner is transferred from the fixing roller onto the second sheet, on a part of the second sheet from which the toner is transferred onto the fixing roller, a toner image for collection is formed.

14. The image forming apparatus according to claim 13, wherein in the cleaning mode, the toner image for collection extends over a length not less than an outer circumferential length of said heating member which is rotatable, with a print ratio not less than 50%.

15. The image forming apparatus according to claim 9, wherein the strength of adhesion between said heating member and toner is less than that between said fixing roller and toner.

* * * * *